US005946806A

United States Patent [19]

Watanabe et al.

[11] Patent Number: 5,946,806

[45] Date of Patent: Sep. 7, 1999

[54] ELECTRIC SHAVER

[75] Inventors: Makoto Watanabe; Nobuhisa Takao; Takashi Fujimoto, all of Sumoto, Japan

[73] Assignee: Sanyo Electric Co., Ltd., Osaka, Japan

[21] Appl. No.: 08/859,181

[22] Filed: May 20, 1997

[30] Foreign Application Priority Data

| | | | |
|---|---|---|---|
| May 29, 1996 | [JP] | Japan | 8-135356 |
| Sep. 9, 1996 | [JP] | Japan | 8-238184 |
| Sep. 9, 1996 | [JP] | Japan | 8-238185 |
| Sep. 9, 1996 | [JP] | Japan | 8-238186 |
| Sep. 9, 1996 | [JP] | Japan | 8-238187 |
| Sep. 9, 1996 | [JP] | Japan | 8-238188 |
| Sep. 9, 1996 | [JP] | Japan | 8-238189 |

[51] Int. Cl.[6] ..... B26B 19/04

[52] U.S. Cl. ..... 30/43.92; 30/346.51

[58] Field of Search ..... 30/34.1, 43, 43.91, 30/43.92, 346.51

[56] References Cited

U.S. PATENT DOCUMENTS

| | | | |
|---|---|---|---|
| 3,002,276 | 10/1961 | Kobler | 30/43.92 |
| 3,037,280 | 6/1962 | De Paoli | 30/43.92 |
| 4,151,644 | 5/1979 | Locke . | |
| 5,398,412 | 3/1995 | Tanahashi et al. | 30/43.92 |
| 5,678,312 | 10/1997 | Wantanabw | 30/43.92 |
| 5,678,313 | 10/1997 | Tezuka et al. | 30/43.92 |
| 5,701,673 | 12/1997 | Ullmann et al. | 30/43.92 |
| 5,706,582 | 1/1998 | Hosokawa et al. | 30/34.02 |
| 5,771,580 | 6/1998 | Tezuka | 30/43.92 |

FOREIGN PATENT DOCUMENTS

| | | | |
|---|---|---|---|
| 0 077 093 | 4/1983 | European Pat. Off. . | |
| 2 240 612 | 3/1975 | France . | |
| 1 789 918 | 6/1959 | Germany . | |
| 1 111 062 | 7/1961 | Germany . | |
| 1 243 563 | 6/1967 | Germany . | |
| 37 43 181 | 7/1988 | Germany . | |
| 43 13 371 | 10/1993 | Germany . | |
| 44 18 644 | 12/1994 | Germany . | |
| 195 39 539 | 5/1996 | Germany . | |
| 310 912 | 11/1955 | Switzerland . | |
| 469782 | 8/1937 | United Kingdom | 30/43.92 |

*Primary Examiner*—Hwei-Siu Payer
*Attorney, Agent, or Firm*—Wenderoth, Lind & Ponac L..L.P.

[57] ABSTRACT

An electric shaver is provided with arched outer blades and outer blades with slit ports opened with several transversely extended parallel slits. Both outer blades are rubbed by the inner blades along their inner faces to cut a beard. Two rows of outer blades with slit ports are mounted on both sides of the arched outer blades. The outer blades with slit ports comprise rectangular parallel blades with the upper faces not exactly planar but almost planar, parallel slits open in the upper face of the rectangular parallel blades and extend from the corner of the external side to the vertical part of the external side.

46 Claims, 30 Drawing Sheets

FIG. 16A
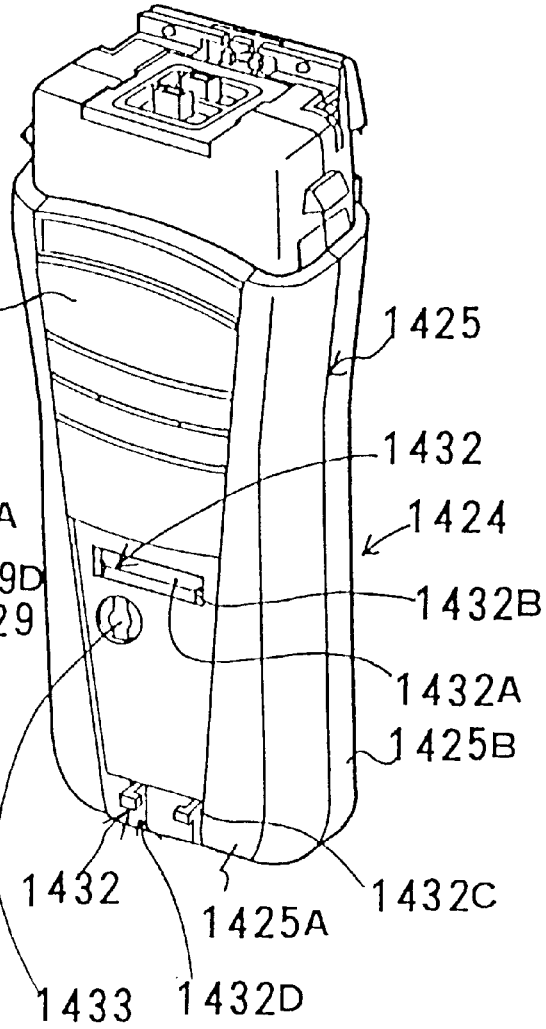
FIG. 16B
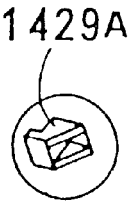
FIG. 16C
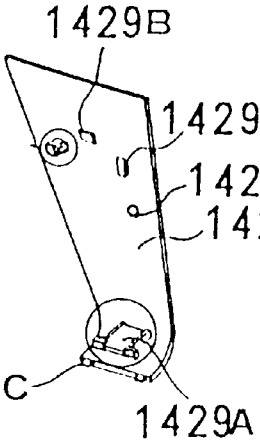
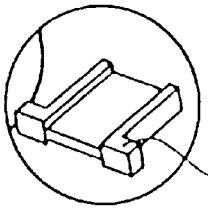
FIG. 16D

ELECTRIC SHAVER

BACKGROUND OF THE INVENTION

The present invention relates to an electric shaver provided with arched outer blades and rectangular outer blades, and especially to an electric shaver provided with rectangular outer blades on both sides of the arched outer blades.

Triple bladed electric shavers have been developed to deeply shave a beard with a good efficiency. This type of shaver allows the protruding part to slide close to the skin and deeply cut the beard because the radius gradient of the mesh cutters bent in the shape of an arch, can be made small. Further, the characteristic of the triple bladed shaver is to shave the beard with a good efficiency. The triple bladed shaver has the particularity to allow efficient shaving, but also, has the drawback that it can almost not shave a vicious beard. This is because the vicious beard does not sprout almost perpendicular to the skin, but is in close contact with the skin because its extremity is curled. This type of beard cannot be inserted into the beard cutting ports of the arched outer blade.

A triple bladed shaver mounted with outer blades with slit ports between the two rows of arched outer blades has been developed to solve this drawback. The upper face of the outer blades with slit ports of the electric shaver is made flat with parallel slits.

Compared with the electric shaver provided with three rows of arched outer blades, the electric shaver provided with outer blades with slit ports placed between the arched outer blades, can quickly cut the vicious beard. Nevertheless, this electric shaver cannot cut the vicious beard with a regular and satisfactory efficiency. FIG. 1 and FIG. 2 show the cutting condition of the vicious beard K by the outer blades 102 with slit ports mounted between the arched outer blades 101. As shown in these figures, the arched outer blades 101 and the outer blades 102 with slit ports shave the vicious beard K in a reciprocating motion along the skin.

As shown in these pictures, the vicious beard is very often curled. Furthermore, the vicious beard does not sprout perpendicular to the skin, but very often grows in a slant direction parallel with the skin. For this reason, making the beard separate from the skin being difficult, the beard cutting ports of the arched outer blades cannot lead the beard in. Especially, as shown in the figures, if the extremity is curled and close to the skin, the beard cutting ports cannot lead the beard in.

To allow the cutting of the vicious beard of this type, the slit outer blades need to lead the vicious beard into the parallel slits of the outer blades with slit ports. But, as shown in FIG. 1 and FIG. 2, when an electric shaver provided with outer blades with slit ports between the arched outer blades, makes a reciprocating motion pressing along the skin H, the arched outer blades 101 press down the vicious beard K that cannot protrude from the skin H and cannot be led into the parallel slit ports of the outer blades 102 with slit ports.

FIG. 1 shows the condition of the slit outer blades 102 moving in the direction in which the beard sprouts. When moving the outer blades 102 with slit ports in this direction the curled vicious beard K is flattened on the skin H by the arched outer blades 101 that progress before the outer blades 102 with slit ports and cannot be led into the parallel slits. Especially, the long vicious beard K that is to be cut is always flattened on the skin H by the preceding beard cutting ports, and the outer blades 102 with slit ports cannot cut it.

As shown in FIG. 2, when the outer blades 102 with slit ports are moved in the opposite direction of the FIG. 1 that is to say the opposite of vicious beard K growing direction, the vicious beard K shaving becomes more difficult. This is because the preceding arched outer blades 101 do not only flatten the vicious beard K on the skin H, but also place it in a transverse direction no longer facing the direction parallel with the parallel slits. To allow vicious beard K cutting with good efficiency, it is necessary to guide the long vicious beard in a direction parallel with the parallel slits and to lead it into the parallel slits.

An electric shaver with comblike outer blades with slit ports has also been developed to reliably make the vicious beard parallel with the parallel slits. But, even if the comblike outer blades with slit ports are moved along the skin, the arched outer blades precede the slit outer blades and flatten the vicious beard on the skin, or change the direction of the vicious beard. Furthermore, the electric shaver with the arched outer blades pressing the extremity of the vicious beard which direction has been changed, cannot always cut the vicious beard even if it is mounted with comblike outer blades with slit ports.

Furthermore, the triple bladed electric shaver has the drawback of not allowing a well balanced inner blade reciprocating motion. This is because, for example, even if the two rows of inner blades move in a reciprocating motion in the opposite direction of the other row of inner blades, it is not possible to make them vibrate in a perfect balance.

The present invention has been developed with the purpose of solving these drawbacks. The important purpose of the present invention is to provide an electric shaver that can reliably cut the vicious beard and also that can shave cleanly and with a good efficiency with the arched outer blades.

The above and further objects and features of the invention will more fully be apparent from the following detailed description and accompanying drawings.

SUMMERY OF THE INVENTION

The electric shaver of the present invention comprises arched outer blades with mesh cutters bent like an arch, arched inner blades having blade edges profiled as the inner face of these arched outer blades and rubbing these blade edges along the inner face of the arched outer blades, and outer blades with slit ports having parallel blades formed with several parallel slits extended in the transverse direction and mounted parallel with the arched outer blades, and slit inner blades having blade edges profiled as the inner face of these outer blades with slit ports and rubbing these blade edges along the inner face of the outer blades with slit ports.

The two rows of outer blades with slit ports are mounted on both sides of the arched outer blades. Furthermore, the outer blades with slit ports have parallel blades shaped rectangular to make the upper face not exactly planar but nearly plane. The rectangular parallel blades are formed with the parallel slits opened at the upper face, and extended from the corner of the external side to the vertical part of the external side.

As shown in FIG. 3 and FIG. 4, the electric shaver of this structure, moves the outer blades with slit ports in the direction of the vicious beard K preceding the arched outer blades. Therefore, the arched outer blades without pressing the vicious beard K, in other words, making the vicious beard K protrude out from the skin H, can lead the beard into the parallel slits of the outer blades with slit ports. When moving the outer blades with slit ports in the growing direction of the vicious beard K, as shown in FIG. 3, functioning as a comb, the parallel slits, lead the vicious beard K in, placing it in a posture parallel with them. At this moment, like in the electric shaver of the prior art, the vicious beard is not pressed by the arched outer blades, can freely change direction and with a good efficiency takes the direction of the parallel slits working like a comb. On the contrary, as shown in FIG. 4, if the outer blades with slit ports are moved, the form can change freely and it is possible to push up and separate the vicious beard K from the skin H. The vicious beard K that protrudes from the skin H can be easily led by the parallel slits and surely cut by the outer blades with slit ports.

Furthermore, the electric shaver of the present invention makes the parallel blades of the outer blades with slit ports preferably thicker than the arched outer blades, and the surface of the opening of the parallel slits is wider than the surface of the opening of the beard cutting ports. The thick parallel blades improve the leading in of the vicious beard into the wider parallel slits reducing the damage to the skin. The thin mesh cutters deeply cut the beard led into the beard cutting ports.

Furthermore, the electric shaver of the present invention is mounted with two rows of arched outer blades and outer blades with slit ports on both sides. The beard is surely led into the parallel slits, or as shown in FIG. 4, making the vicious beard K protruding more from the skin H, it is led into the parallel slits and surely cut.

Furthermore, when moving the electric shaver of the present invention in a reciprocal manner along the skin, it reliably cuts the vicious beard K coming close to it from both sides in opposite directions, as shown in FIG. 3 and FIG. 4. in the condition where the arched outer blades do not flatten the vicious beard K but in the condition where the vicious beard K protrudes from the skin H, it is led into the parallel slits and surely cut. This is because outer blades with slits ports are mounted on the external side of the arched outer blades and on both sides.

Furthermore, the characteristic of the electric shaver of this structure is to allow the leading of the vicious beard extremely smoothly into the parallel slits opened and extended to the vertical part of the external sides of the parallel blades. As shown in FIG. 3 and FIG. 4, when the outer blades with slit ports of the electric shaver of this structure are moved along the skin H, the outer blades with slit ports are free on their whole width because there is no arched outer blade in front of them. The front face of the free outer blades with slit ports, in other words, the parallel slits provided with an opening from the external side corner to the vertical part of the outer structure moving the two rows of arched inner blades in an opposite direction reciprocating motion and the rows of slit inner blades also in an opposite direction reciprocating motion and making one row of arched inner blades and one row of slits inner blades in one piece and moving them together in a reciprocation motion, allows reduction of the vibrations with a good balance.

The characteristic of the electric shaver of this structure is to shave the vicious beard in an ideal condition with its outer blades with slit ports, then to shave it cleanly with its arched outer blades. This is because the electric shaver is mounted with outer blades with slit ports on both sides of the arched outer blades and also because the parallel blades of these arched outer blades are rectangular and opened with parallel slits at the upper face and extended from the corner of the external side to the vertical part of the external side. Like the prior art, the electric shaver of this structure does not cut the beard with the parallel blades following the arched outer blades. When shaving by moving the outer blades along the skin in a reciprocal manner, the outer blades 2 with slit ports opened with parallel slits until the vertical part of the external side, as shown in FIG. 3 and FIG. 4, precede the arched outer blades and shave. When moving the outer blades with slit ports preceding the arched outer blades, in the direction shown in FIG. 3, and arranging in line the protruding vicious beard K blades with slit ports come close to the vicious beard K and quickly lead the beard in. Especially, the vicious beard K that cannot be said protrude from the skin H, also the vicious beard that almost does not protrude from the skin, is arranged by the parallel blades like by a comb and is led quickly into the parallel slits and surely cut.

Furthermore, the electric shaver characterized in that the parallel blades of the outer blades with slits ports are thicker than mesh cutters of the arched outer blades, and the opening of the parallel slits are wider than the beard cutting ports, not only reliably cuts the vicious beard with the outer blades with slit ports, but also shaves cleanly without any damage to the skin. This is because the vicious beard is reliably led into the widely opened parallel slits and can be cleanly cut short by the beard cutting ports of the thin mesh cutters, with the thick parallel blades avoiding any damage to the skin. The thick parallel blades do not damage the skin because they do not shave deeply.

Furthermore, the characteristic of the electric shaver with arched outer blades protruding more than outer blades with slit ports is to allow deep shaving of the beard with a good efficiency.

BRIEF DESCRIPTION OF THE DRAWINGS

FIG. 16 is an oblique view showing an inverted decoration panel of the electric shaver shown in FIG. 14.

DETAILED DESCRIPTION OF THE INVENTION

Figure 5:
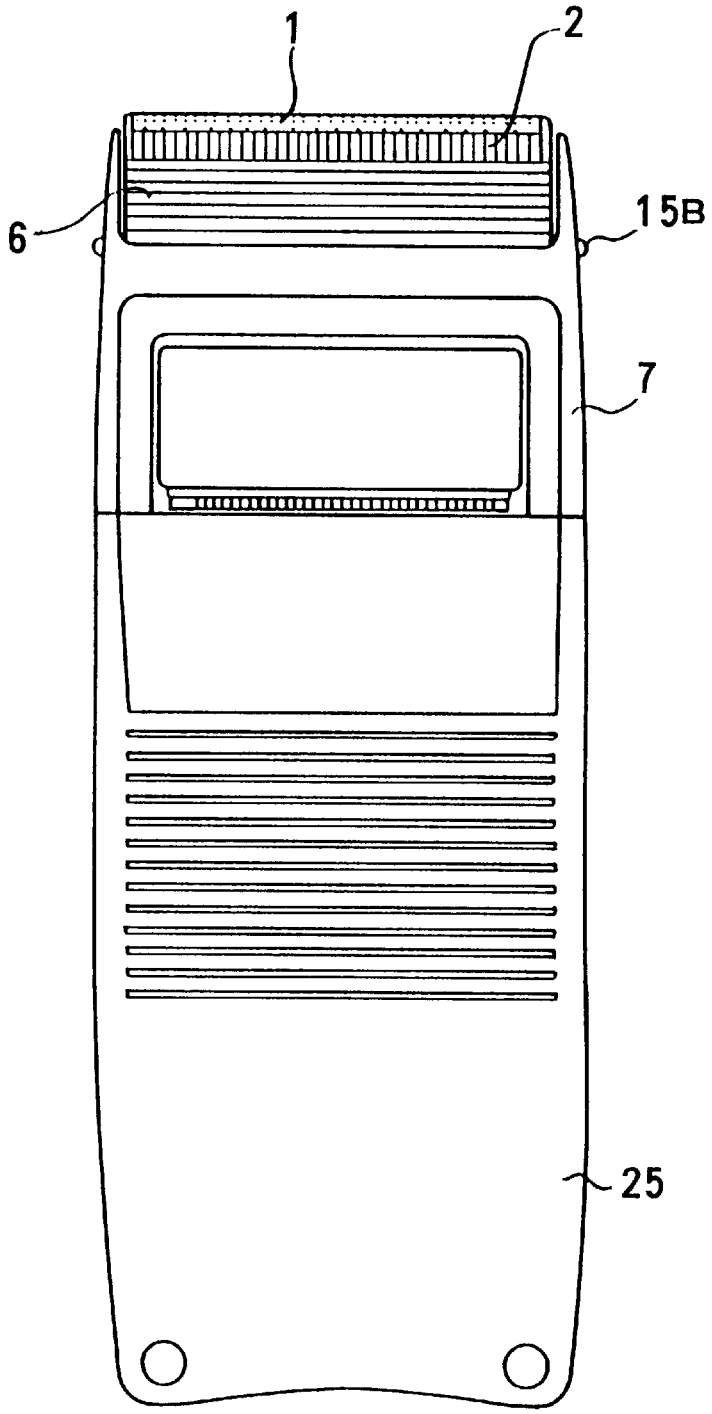
FIG. 5 is a front view showing the electric shaver of an embodiment of the present invention.
Figure 6:
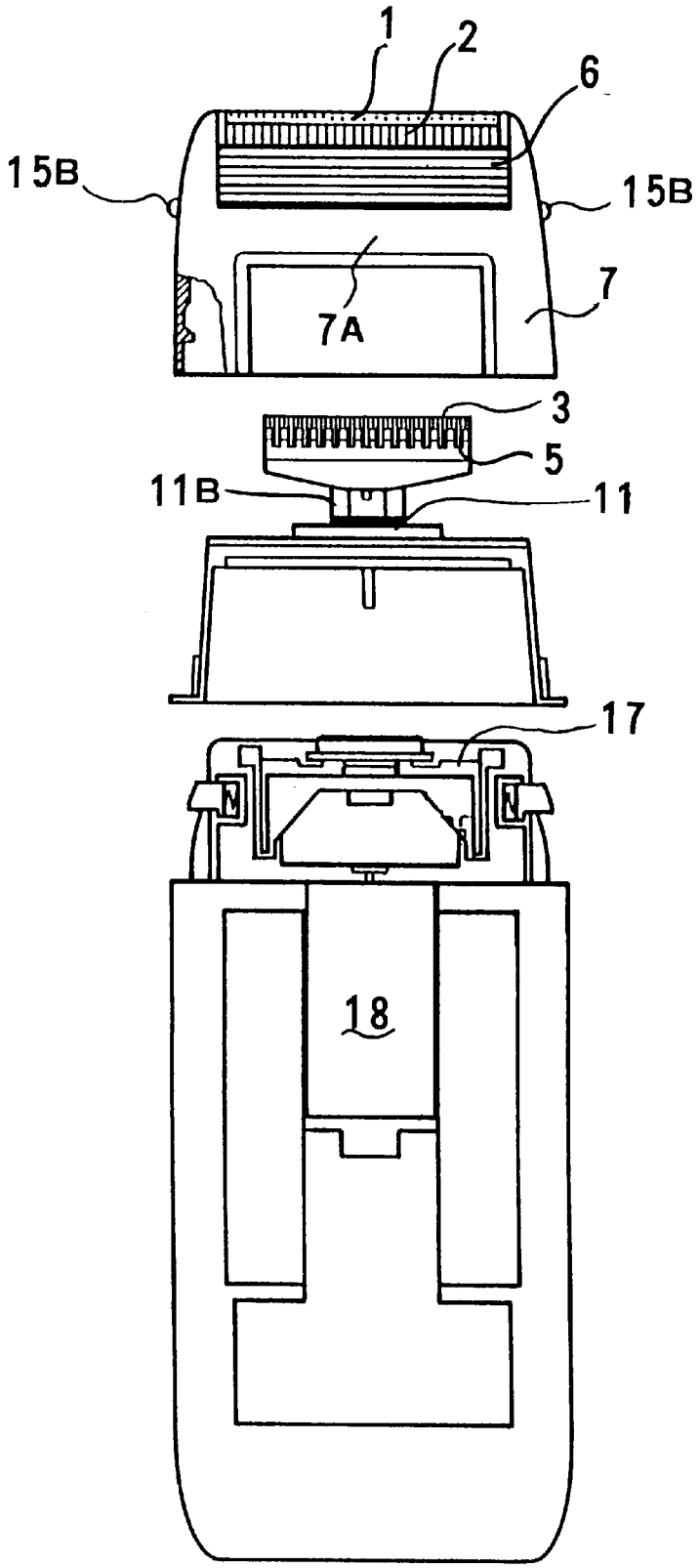
FIG. 6 is an exploded front view of the electric shaver shown in FIG. 5.
Figure 7:
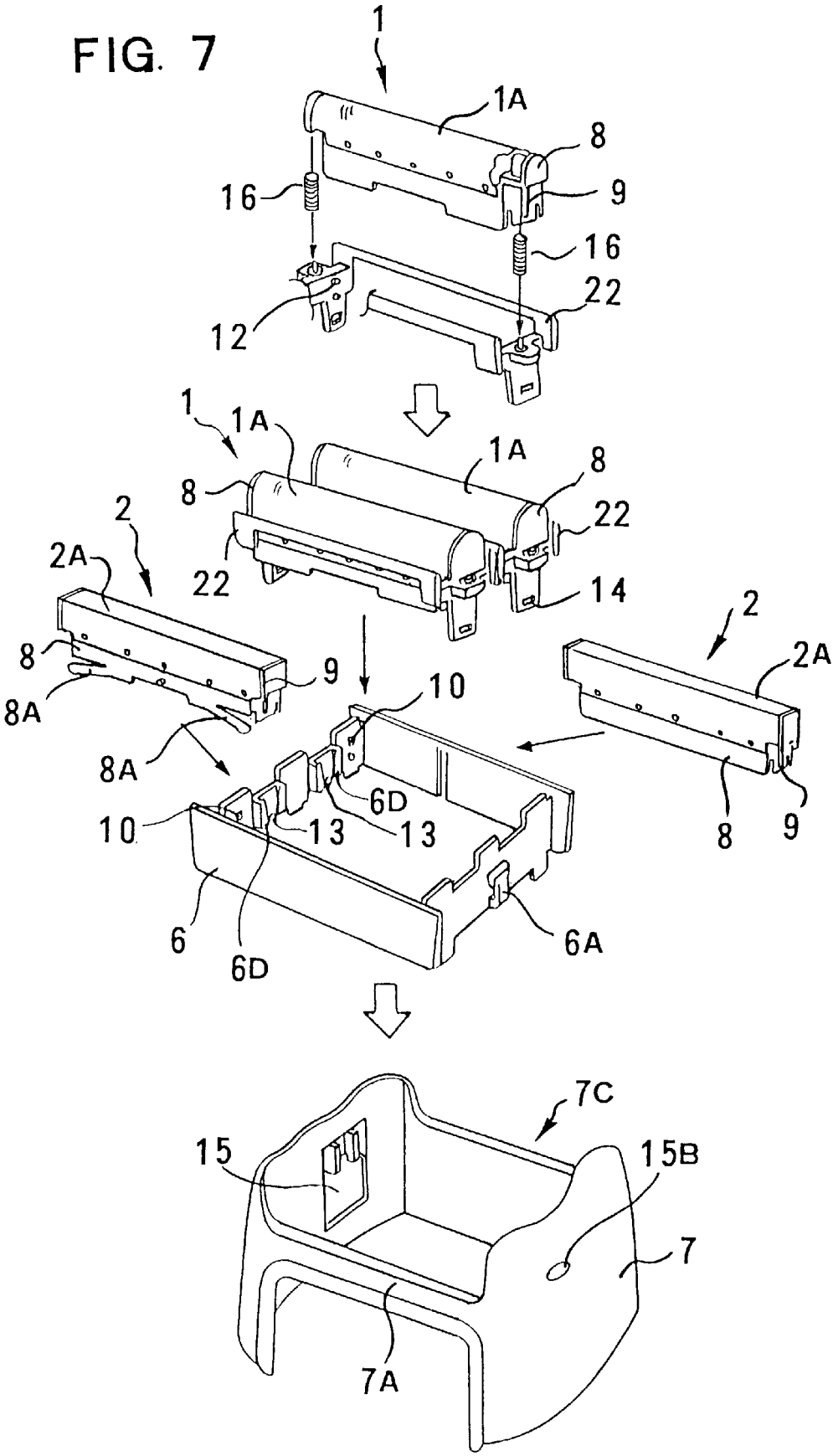
FIG. 7 is an exploded oblique view showing arched outer blades and the outer blades with slit ports of the electric shaver in FIG. 5, in an exploded condition.

The electric shaver shown in FIG. 5 or in FIG. 7, is provided with two rows of arched outer blades (also referred to as a pair of elongated arched outer blades) 1, two rows of outer blades 2 with slit ports (also referred to as a pair of elongated slot port outer blades) an outer blade case 6 that mounts in a removable manner and in parallel with the arched outer blades 1 and the outer blades 2 with slit ports, an outer blade frame 7 that mounts in the outer blade case 6 in a removable manner, arched inner blades 3 that rub and press against the inner face of arched outer blades 1, slit inner blades 5 that rub and press against the inner face of the outer blades 2 with slit ports, an inner blade stage 11 connecting the arched inner blades 3 and the slit inner blades 5, and a mechanism for driving the inner blade stage 11 in a reciprocating motion.

The two rows of arched outer blades 1 and the two rows of outer blades 2 with slit ports are mounted as shown in FIG. 7, independently in the outer blade case 6. The outer blades 2 with slit ports are positioned at the external side and parallel with the two rows of arched outer blades 1. The arched outer blades 1 are mounted in a position protruding out more than the outer blades 2 with slit ports. This is to allow the clean finishing shaving of the beard with the arched outer blades 1 pressing surely on the skin.

Figure 1:
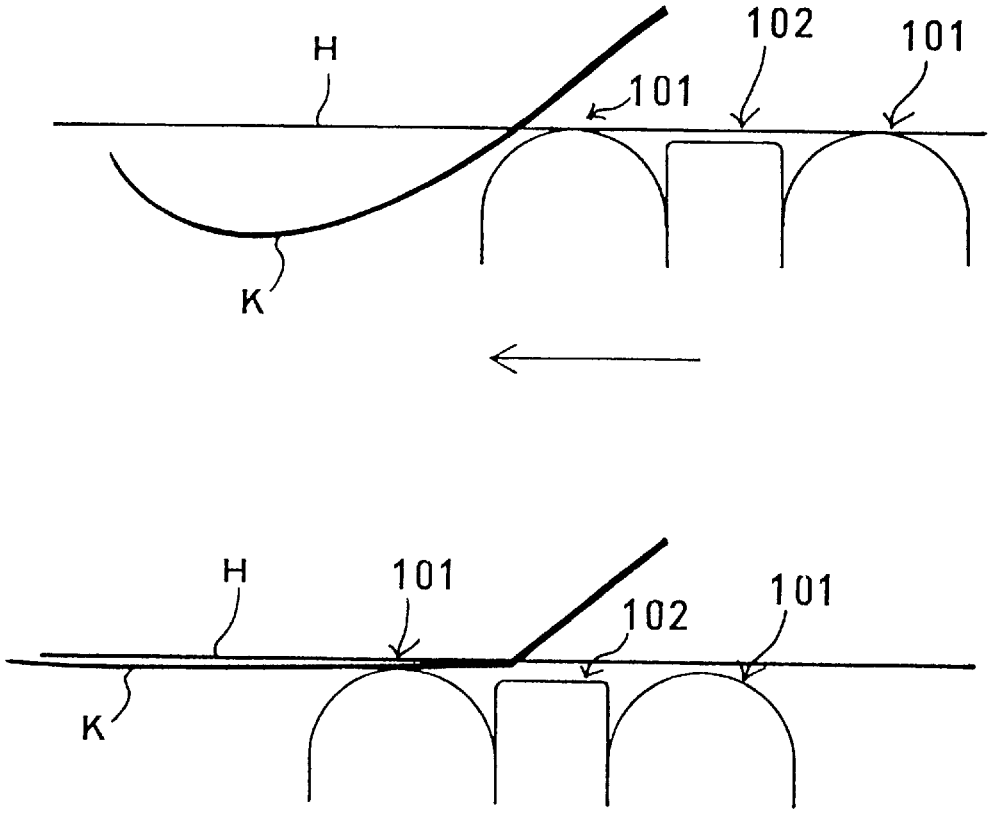
FIG. 1 (PRIOR ART)
FIG. 1 is a cross-sectional view showing a cutting condition of a vicious beard by prior art outer blades with slit ports.
Figure 2:
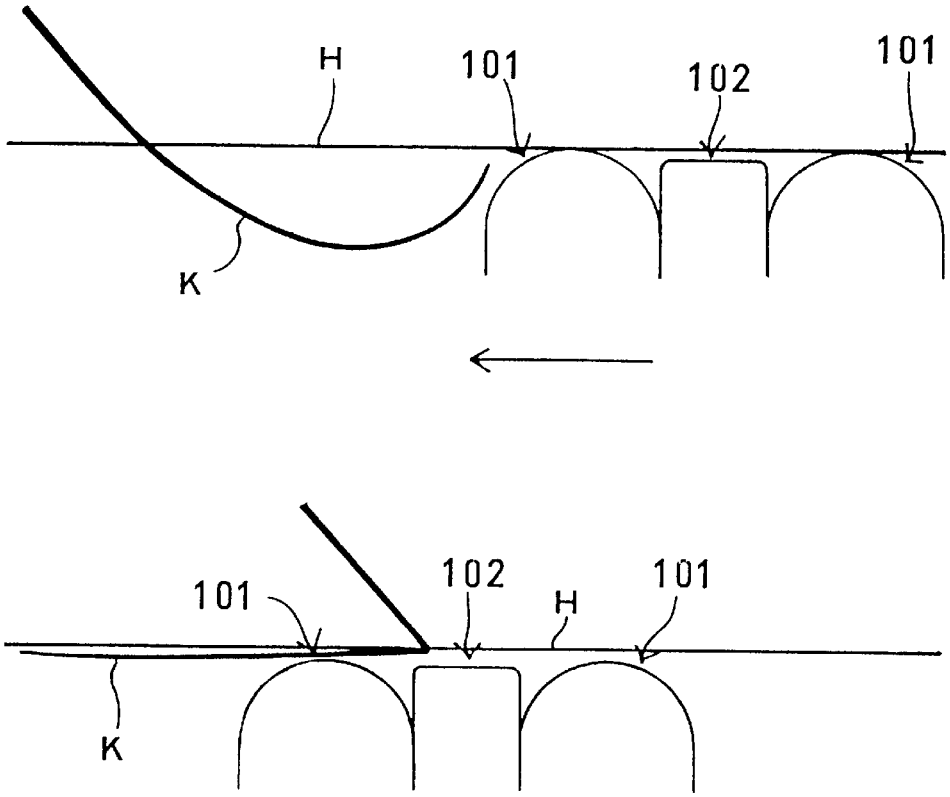
FIG. 2 (PRIOR ART)
FIG. 2 is a cross-sectional view showing a cutting condition of the vicious beard by the prior art outer blades with slit ports.
Figure 3:
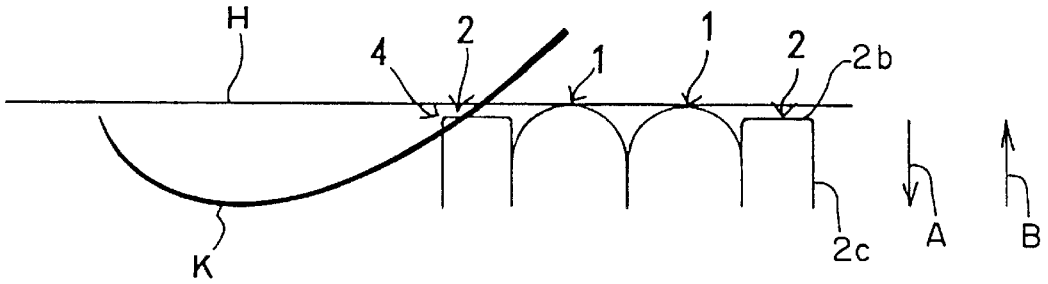
FIG. 3 is a cross-sectional view showing cutting condition of the vicious beard by outer blades with slit ports of the electric shaver of an embodiment of the present invention.
Figure 4:
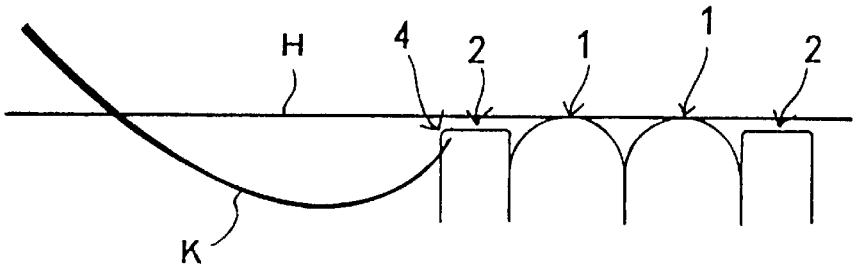
FIG. 4 is cross-sectional view showing a cutting condition of the vicious beard by the outer blades with slit ports of the electric shaver of an embodiment of the present invention.

As shown in FIG. 3, each of the outer blades with slit parts (i.e. the slit part outer blades) 2 has a profile opening in a first direction A, flattened at a surface 2*b* facing a second direction B opposite the first direction A and having an external side 2*c* facing away from the arched outer blades 1.

The mesh cutters 1A, as shown in FIG. 7, are fixed in the plastic blade support 8 on the arched outer blades 1. The mesh cutters 1A are made of a thin sheet metal having a thickness of for example 30~100 $\mu$m, and preferably of about 50 $\mu$m, and fixed on the blade support 8 bent in the shape of an arch. Numerous beard cutting ports are opened in the mesh cutters 1A. The blade support 8 is a hard plastic long square column opened on both upper and lower extremities.

Figure 8:
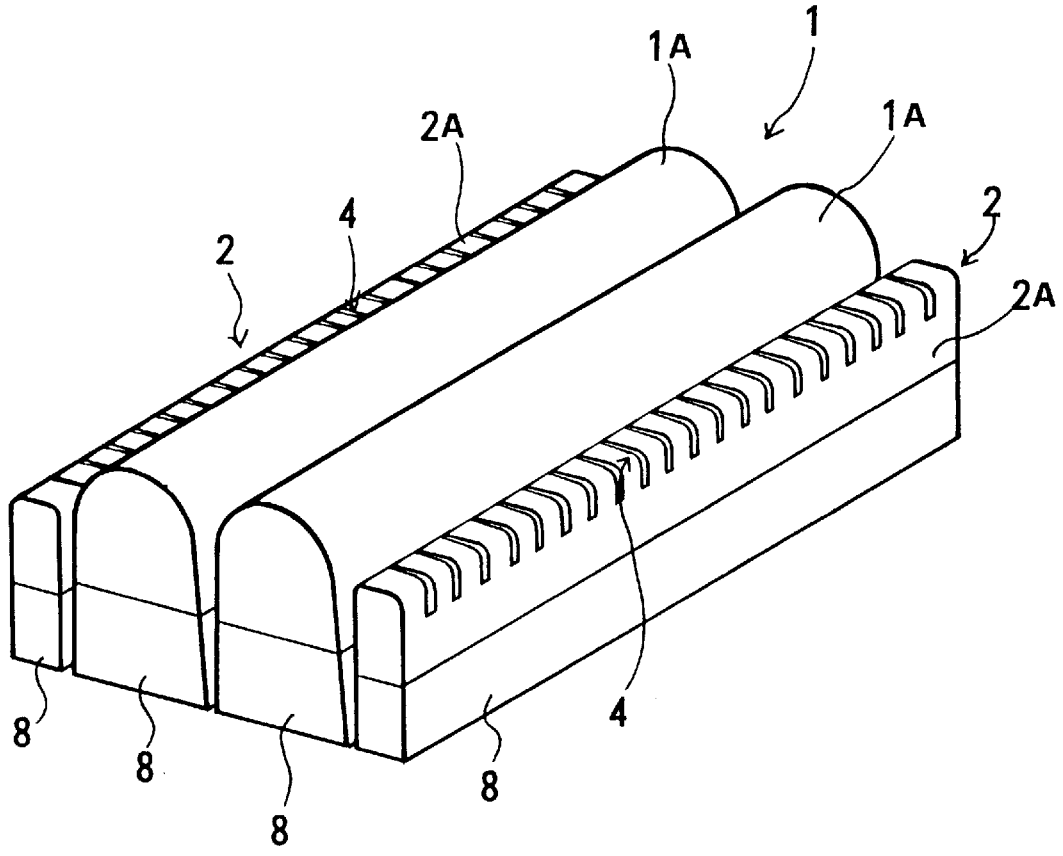
FIG. 8 is an oblique view of the arched outer blades and the outer blades with slit ports of the electric shaver shown in FIG. 5.
Figure 9:
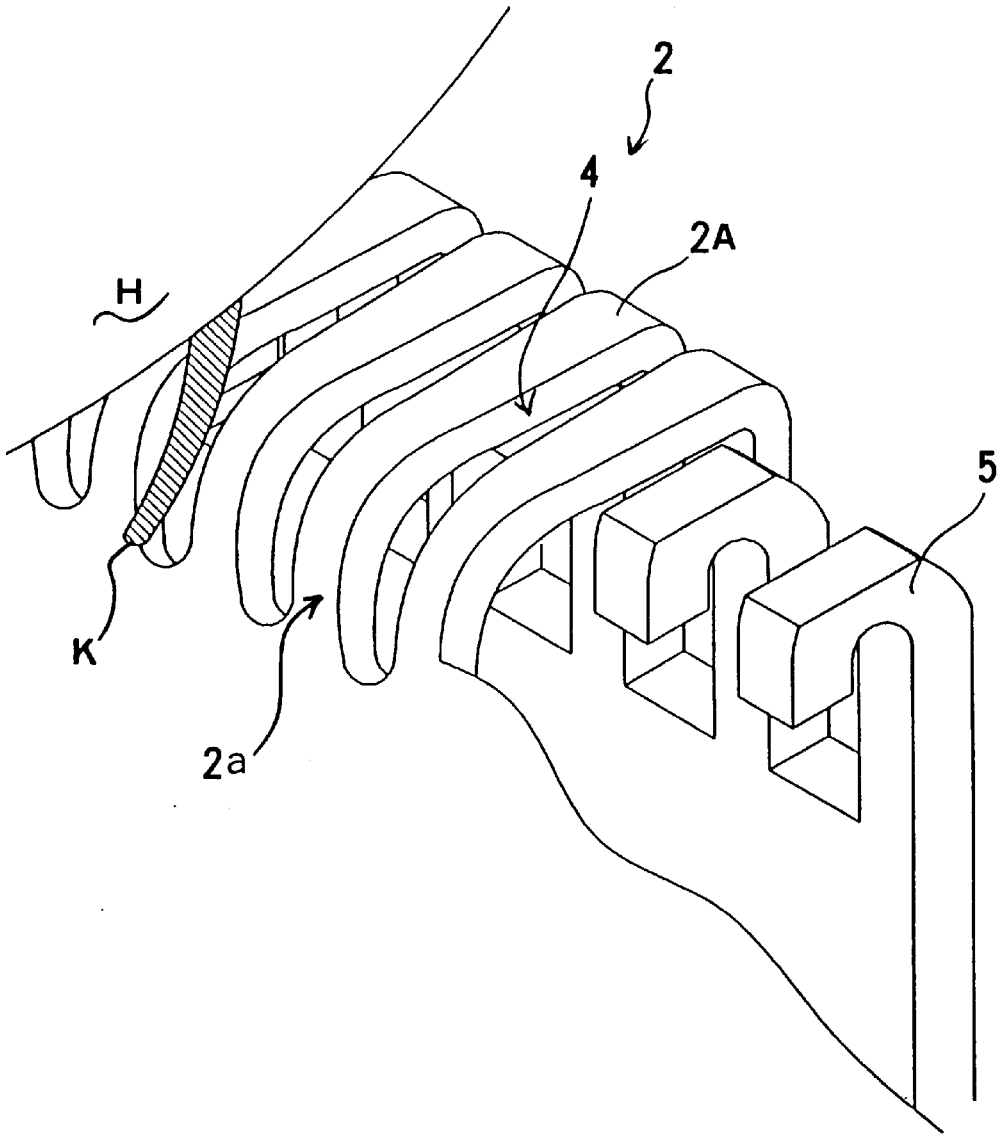
FIG. 9 is an oblique view showing the cutting condition by a outer blades with slit ports and slit inner blades, of the beard led into parallel slits.

As shown in FIG. 8, the outer blades 2 with slit ports fix the parallel blades 2A in the plastic support 8. As shown in FIG. 9, the parallel blades 2A are made of a sheet metal opened with several parallel slits 4 extended in the transverse direction. The upper face of the parallel blades 2A is made of a rectangular sheet metal bent to become planar, and is opened with the parallel slits 4 that extend from the corner of the upper face and the external side, to the external side of the vertical part 2*a*. The width of the parallel slits 4 of the outer blades 2 with slit ports shown in FIG. 8, is tapered to get wider towards the external side. The characteristic of the parallel blades 2A of this type is that they arrange the vicious beard K like a comb and that they can smoothly lead the beard into the parallel slits 4.

The upper face of the parallel blades 2A is planar, as shown in FIG. 8 and in FIG. 9. The electric shaver of the present invention does not need a perfectly planar parallel blade upper face. For example, it is possible to make it almost planar by bending it with a radius gradient larger that the one of the arched outer blades bent in the shape of an arch.

The thickness of the parallel blades 2A is from 0.1 to 0.5 mm and optimally from 0.2 to 0.3 mm, which is 2 to 10 times the mesh cutter thickness, and optimally 5 times. The parallel blades 2A are made thicker to widen the slit ports of the outer blades 2 and to reduce the damage to the skin. To allow the smooth introduction of the vicious beard into the parallel slits 4, it is necessary to widen the parallel slits 4. But, when making the width of the parallel slits 4 wider, the skin is pressed in and is easily damaged by the slit inner blades 5 rubbing the inner face. To avoid this drawback, the parallel blades 2A are made thicker. As long as the skin is not pushed deeply into the parallel slits 4, the thick parallel blades 5 do not damage the skin with the slit inner blades 5.

Making the width of the parallel slits 4 larger, the parallel blades 2A that are thicker than the mesh cutters 1A of the beard cutting ports, cut the vicious beard precisely and also reduce the damage to the skin. The parallel blades 2A of the outer blades 2 with slit ports, cut the beard roughly. The beard that has been roughly cut is finely cut by the arched outer blades 1 that move along the skin, following the outer blades 2 with slit ports. The extremity of the vicious beard that has been cut short, can easily be introduced into the beard cutting ports of the arched outer blades 1 and is cleanly cut by beard cutting ports.

The arched outer blades 1 and the outer blades 2 with slit ports are independently mounted into the outer blade case 6. The arched outer blades 1 and the outer blades 2 with slit ports fix the mesh cutters 1A or the parallel blades 2A to the plastic blade support 8 having a square column shape. The blade support 8 of the outer blades 2 with slit ports provided with the arched outer blades 1 on both sides, as shown in FIG. 7, is built in one piece with the elastically deformable struts 8A at both extremities projecting from the lower face.

The elastically deformable struts 8A are a material for flexibly pushing out the outer blades 2 with slit ports. With the shape of a rod, the elastically deformable struts 8A project, making a declivity from the center of the blade support 8 towards both extremities. As shown in this figure, the characteristic of the blade support 8 mounted with the elastically deformable struts at both extremities, is that it can move parallel to the outer blades 2 with slit ports by the two elastically deformable struts 8A.

The elastically deformable struts 8A press the upper face of the opening 7A of the outer blade frame 7 by the extremity, pushing out the outer blades 2 with slit ports towards the skin. Therefore, in the condition where the outer blades 2 with slit ports are fixed to the outer blade frame 7, the elastically deformable struts 8A protruding downwards from the outer blade case 6, are provided at a position pressing the upper face of the opening 7A of the outer blade frame 7. The electric shaver provided with four rows of outer blades can push the outer blades 2 with slit ports mounted on both sides by the upper face of the opening 7A on the outer blade frame 7. The two rows of slit outer blades 2 that are provided on both sides, are mounted with the elastically deformable struts 8A on the face that can press the upper face of the opening of the outer blade frame 7, and on one side of the outer blade support 8.

The arched outer blades 1 provided at the inner face of the outer blades 2 with slit ports, are pushed out towards the skin, not by the elastically deformable struts, but through the extremity springs 16 that are coil springs. Consequently there is no need to provide elastically deformable struts on the blade support 8 of the arched outer blades 1. The edge springs 16 press the arched outer blades 1 against the skin with less pressure than elastically deformable struts with a large stroke. When it is near by perpendicular to the skin, a quadruple bladed shaver presses on the arched outer blades 1 lighter than the outer blades 2 with slit ports, and the arched outer blades 1 sink deeply until they reach the same level as the outer blades 2 with slit ports, allowing all the four rows of outer blades, that is to say the outer blades 2 with slit ports and the arched outer blades 1, to press comfortably against the skin.

The outer blades 2 with slit ports mount in the outer blade case 6 in a manner allowing up and down movement. Therefore the outer blades 2 with slit ports are provided with vertical slits 9 at both ends of the blade support 8. Guide projections 10 protruding on the inner face of the outer blade case 6 mate with the vertical slits 9. The outer blades 2 with slit ports are mounted in the outer blade case 6 to allow their vertical movement via the vertical slits 9 and the guide projections 10. When the outer blades 2 with slit ports move up and down, the guide projections 10 move up and down within the vertical slits 9.

The arched outer blades 1 mount in the outer blade case 6 in a manner allowing up and down movements via the center blade stage 22 of the outer blade case 6. The outer blade case 6 of this figure, is provided with a center blade stage 22 for coupling the arched outer blades 1. The arched outer blades 1 in the condition where they are pushed out by the edge spring, are mounted so that they can move up and down in the center blade stage 22. The center blade stage 22 connects with the outer blade case 6 in a manner that does not allow up and down movements. The connecting structure of the arched outer blades 1 to the center blade stage 22 of the outer blade case 6, is the same that mounts the outer blades 2 with slit ports in the outer blades case 6. Namely, vertical slits 9 are provided at both ends of the blade support 8 of the arched outer blades 1, and guide projections 12 which insert into the vertical slits 9 are provided on the center blade stage 22 and the guide projections 12 slide within the vertical slits 9 allowing the arched outer blades 1 to move up and down.

The center blade stage 22 connects with the outer blade case 6 by insertion into the connecting columns 6D provided on the inner faces of the outer blade case 6. A locking projection 13 at the lower extremity of each connecting column 6D catches in a locking hole 14 on the inserted center blade stage 22 to prevent by the locking projection 13, the disconnection of the center blade stage 22.

Figure 10:
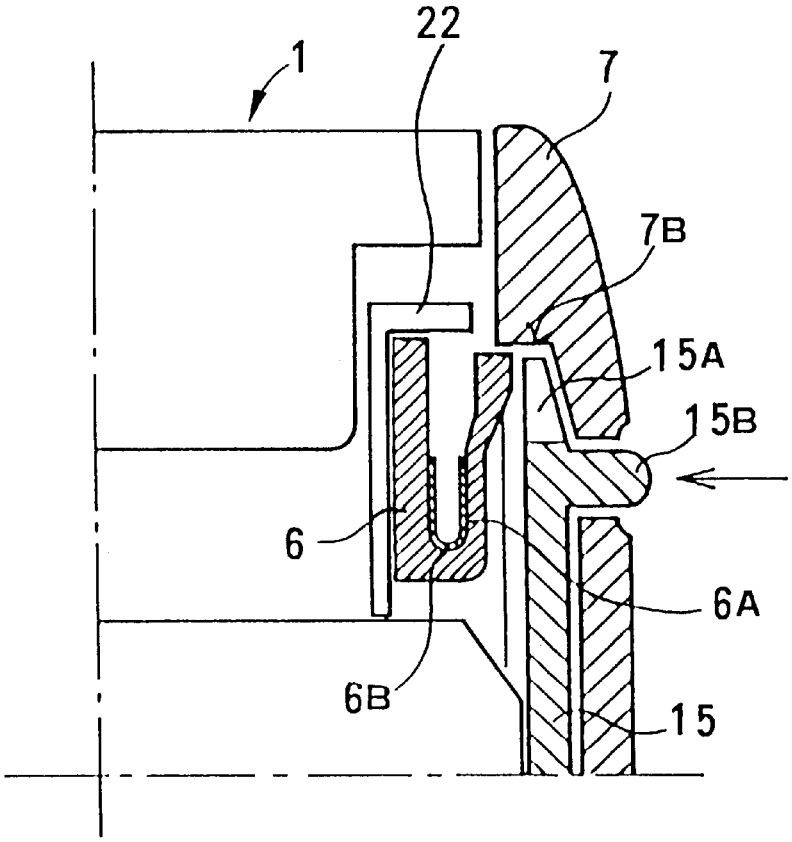
FIG. 10 is a cross-sectional view of a mounting part in a removable fashion of an outer blade case.

The outer blade case 6 mates with the outer blade frame 7 in a removable fashion. As shown in FIG. 7 and in FIG. 10, the outer blade case 6 is provided with a latching piece 6A which catches in the latching detent 7B and is mounted in a removable fashion in the outer blade frame 7. The latching piece 6A projects out from both extremities of the outer blade case 6 and is extended from the bottom to the top. The latching piece 6A has a built-in flexible sheet metal 6B on its inner face giving it the ability to elastically deform. The upper end of the latching piece 6A is widened giving it a T-shape. As shown in the cross-sectional view of FIG. 10, the outer blade frame 7 is provided with latching detents 7B which are aligned to catch the latching pieces 6A when the outer blade case 6 is attached. When mounting the outer blade case 6 on the outer blade frame 7, the latching pieces 6A slide into the latching detents 7B.

Latch releases 15 are disposed within the latching detents 7B of the outer blade frame 7 to disconnect the outer blade case 6 from the outer blade frame 7. The latch release 15 is formed in one piece and made of flexible plastic. The lower extremity of the latch release 15 is fixed to the outer blade frame 7 allowing the upper extremity to deform elastically. The pressure rods 15A which push against both extremities of the T-shaped latching pieces 6A are formed as a single piece at the upper extremity of the latch release 15. Further the push buttons 15B which project out of the external part of the outer blade frame 7 are also formed in one piece with the latch release 15. The push buttons 15B insert through holes in the outer blade frame 7 in a manner allowing them to move in and out. The push buttons 15B are pressed to disconnect the outer blade case 6 from the outer blade frame 7. When the push buttons 15B are pressed, the pressure rods 15A push the latching pieces 6A out of the latching detents 7B releasing the lock between the outer blades case 6 and the outer blade frame 7 and are pulled out from the outer blade frame 7.

The outer blade frame 7 has an opening 7C to accept the outer blade case 6 with almost no gap. The opening 7C aligns the upper face of the opening of the outer blade frame 7A with the lower face of the outer blades 2 with slit ports. The thickness of the opening of the outer blade frame 7A is designed to allow the pressure from the elastically deformable struts 8A provided in the blade supports 8. In the electric shaver shown in the figures, the outer blade frame 7 mounts on the electric shaver body 25 in a removable manner, but it is also possible for the outer blade frame and the electric shaver body to be intergrated into one piece.

As shown in FIG. 7, the arched outer blades 1 or the outer blades with slit ports, and the outer blade case 6 and the outer blade frame 7 are assembled as follows.

① The arched outer blade 1 is mated to the center blade stage 22. The arched outer blade 1 mates the vertical slits 9 into the guide projection 12 to connect in the center blade stage 22.

② The outer blades 2 with slit ports and the arched outer blades 1 connected in the center blade stage 22 are arranged in parallel and mounted into the outer blade case 6. The outer blades 2 with slit ports, mount in the outer blade case 6 through the vertical slit 9 and the guide projection 10. The center blade stage 22 is inserted and coupled with the connecting column 6D of the outer blade case 6.

③ The outer blade case 6 connected with the arched outer blades 1 and the outer blades 2 with slit ports, is inserted in the opening 7C of the outer blade frame 7. In the outer blade case 6 that has been inserted into the outer blade frame 7, the latching pieces 6A are inserted into the latching detent 7B in a manner not allowing easy disconnection.

In this condition, the outer blades 2 with slit ports mounted in the outer blade frame 7, press in a deformable manner against the upper face of the opening of the outer blade frame 7 by the elastically deformable struts 8A. Through the reaction force of the elastically deformable strut 8A pressing the opening of the outer blade frame 7, the outer blades 2 with slit ports, being flexibly pushed upward, connect into the outer blade case 6.

Therefore, when the electric shaver is used, and the outer blades 2 with slit ports press against the skin, each arched outer blade 1 and each outer blade 2 with slit ports are pressed flexibly against the skin with high efficiency and shave the beard.

Figure 11:
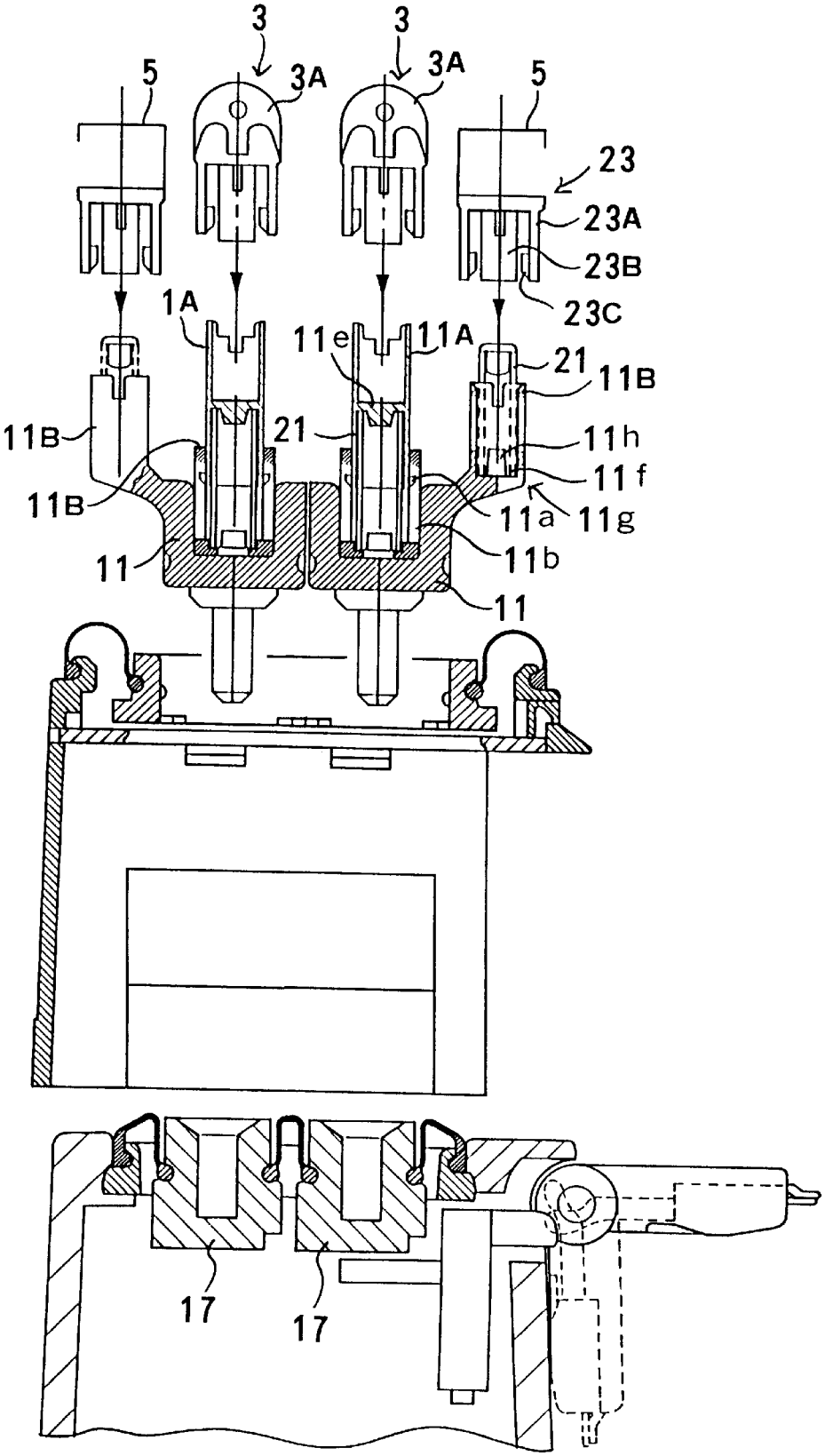
FIG. 11 is a partial cross-sectional lateral view showing a connecting condition of the arched inner blades and the slit inner blades to an inner blades stage.

As shown in FIG. 11, the inner blade connects the arched inner blade 3 and the slit inner blade 5 in the inner blade stage 11. The two rows of arched inner blades 3 are moved in an opposing reciprocal motion, and allowing also the two rows of slit inner blades 5 provided in the external side of the arched inner blades 3 to move in opposing reciprocal motion, the one row of arched inner blade 3 and the one row of slit inner blade 5 are made in one piece, and are connected in the two inner blade stages 11 vibrating each other in an opposing manner.

As shown in FIG. 11, the arched inner blade 3 is manufactured with several sheets of blade plates 3A arranged in parallel and inserted into plastic. The blade plate 3A is made of metal, and the upper extremity is bent so that it enters into contact with the inner face of the arched outer blade 1 that is bent like an arch.

As shown in FIG. 9, the extremity of the slit inner blade 5 is bent in the shape of an "L", is made of metal and provided with comblike slits, and like the arched inner blade 3, it is mounted and inserted into plastic. The upper face of the slit inner blade 5 rubs against the inner face of the parallel blade 2A, and cuts the beard that is introduced into the parallel slits 4 of the parallel blade 2A.

Figure 13:
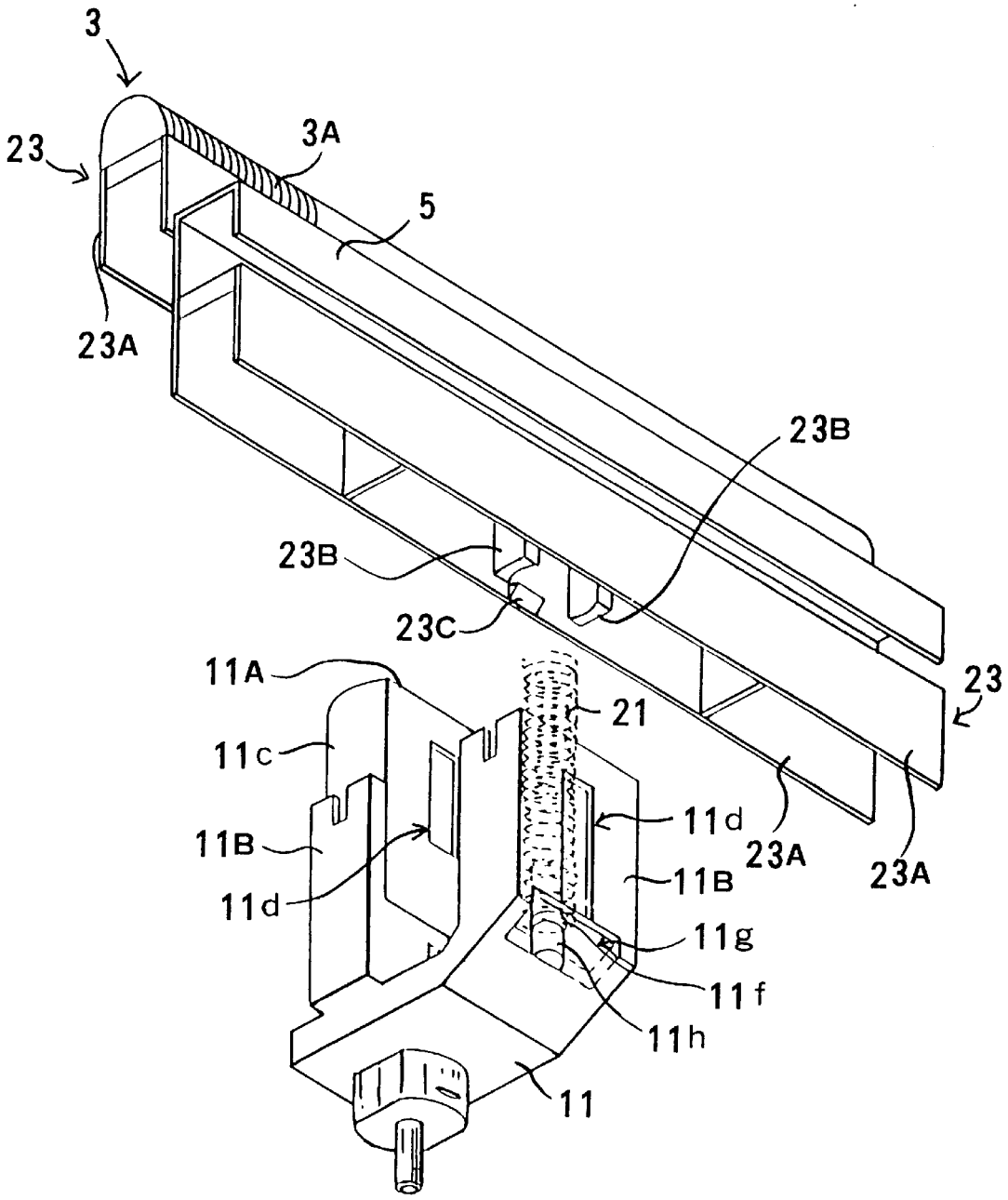
FIG. 13 is an oblique view showing the connecting condition of the arched inner blades and the slit inner blades to the inner blade stage.

The plastic support 23 inserting the blade plate 3A of the arched inner blade 3, or the metallic blade of the the slit inner blade 5 is made in one piece with the inner side of the parallel side wall 23A mounted on the opposite side and parallel, as shown in FIG. 13, and with a pair of the connecting support struts 23B. The connecting support strut 23B is connected and inserted into the vertical column 11B of the inner blade stage 11. The central spring 21 pressing in a flexible manner the slit inner blade 5, is mounted between the connecting support struts 23B as shown by the dotted line in FIG. 13. Therefore, the interval of the connecting support struts 23B has been designed slightly larger than the outer circumference of the central spring 21 to allow insertion of the central spring 21 in between. Furthermore, the inner side that is the opposing face of the connecting support strut 23B, has been bent to form a cavity at the center to mate the surface of the central spring 21, as shown in FIG. 13. The interval of the outer side of the connecting support struts 23B has been designed to be almost the same as the interval of the inner side of the vertical column 11B since it is inserted into the vertical column 11B of the inner blade stage 11.

Furthermore the parallel side wall 23A forms the lock 23C protruding at the inner face. When connecting the outer blades with slit ports to the inner blade stage 11, the lock 23C is a locking device preventing easy releasing from the inner blade stage 11. The lock 23C is located at the center of the parallel side wall 23A and the lower extremity is made in one piece with it. Further, as shown in FIG. 13, to allow smooth insertion of the lock 23C into the inner blade stage 11, the lock 23C is designed like a hook with tapered opposing faces. When the inner blade stage 11 has connected the outer blade 2 with slit ports, the lock 23C is introduced in the latching window 11*d* of the vertical column 11B, and the inner blade is prevented from releasing from the inner blade stage 11. When inserting and connecting the parallel side wall 23A of the inner blade and the connecting support strut 23B with the vertical column 11B of the inner blade stage 11, that interval getting slightly larger by the elastic deformation of the parallel side wall 23A, the lock 23C is introduced into the latching window 11*d* of the vertical column 11B. When the lock 23C is introduced into the latching window 11*d*, the interval of the parallel side wall 23A gets narrower and the lock 23C locks inside the latching window 11*d*.

Because the parallel side wall 23A is inserted into the external side of the vertical column 11B of the inner blade stage 11, and the connecting support strut 23B into the inner side of the vertical column 11B of the inner blade stage 11, there is an interval between the parallel side wall 23A and the connecting support strut 23B, designed so that the vertical column 11B of the inner blade stage 11 can be introduced.

The outer blades 2 with slit ports are directly connected to the inner blade stage 11 and the arched inner blades 3 mounted at the inner side of the outer blades 2 with slit ports connect the inner blade stage 11 via the up-down stage 11A. The up-down stage 11A, as shown in FIG. 11, pressed by the central spring 21 that is a coil spring, is connected to the vertical column 11B of the inner blade stage 11 to allow up-down motion. The stopper protuberance 11*a* is provided at the lower extremity of the up-down stage 11A to prevent it from coming off easily from the vertical column 11B.

The stopper protuberance 11*a* hooked into the upper edge of the retaining slits 11*b* designed vertically along the side surface of the vertical column 11B, prevents the up-down stage 11A from getting off the vertical column 11B. The up-down stage 11A is inserted into the vertical column 11B to allow the up-down motion in a vertical posture. To keep the vertical posture of the up-down stage 11A, a shallow ditch is shaped in the opposing face of the vertical column 11B that is designed so that the sliding surface 11*c* of the up-down stage 11A follows this ditch. The up-down stage 11A connects the arched inner blade 3 at its upper extremity. The arched inner blade 3 is connected in a manner that does not allow up-down motion compared with the up-down stage 11A. This is because the arched inner blade 3 is moved up and down when the up-down stage 11A moves up and down. Like the shape of the upper part of the vertical column 11B on both sides, the upper extremity of the up-down stage 11A is opened with the latching windows 11*d* on both side surfaces to catch the locks of the inner blade 5. Furthermore, the up-down stage 11A is designed like a square column to hold the central spring 21, and is provided at the center with the base plate 11*e* that presses the upper edge of the built-in central spring 21. The lower face of the base plate 11*e* is shaped like a protuberance to introduce the upper extremity of the central spring 21. The vertical column 11B of the inner blade stage 11 is provided with the insertion rod 11*h* at the lower part of the inner side to decide the position of the central spring 21.

The insertion rod 11*h* protrudes from that surface as shown in FIG. 11 and FIG. 13, and is made in one piece with the retaining flange 11*f* that catches the central spring. The retaining flange 11*f* protrudes between the spirals of the spiral type central spring 21 and catches the central spring 21. Therefore, the width of the retaining flange 11*f* is designed to allow insertion between the spirals of the central spring 21. Catching the lower end of the central spring 21, the retaining flange 11*f* prevents the coming off of the central spring 21 from the insertion rod 11*h* when the retaining flange 11*f* is released from the inner blade stage 11 of the inner blade. But, if the central spring 21 is strongly pulled, or if the central spring 21 is twisted and pulled, the central spring 21 will deform or the spiral central spring 21 will come off the retaining flange 11*f*, and it is then possible to take the central spring 21 off.

As shown in FIG. 11, the window 11*g* is opened in the lower face of the vertical column 11B connecting the slit inner blade 5 and positioned at the bottom of the retaining flange 11*f*. The retaining flange 11*f* positioned at the upper side of the window 11*g*, is provided at one side of the insertion rod 11*h*. The up-down position of the retaining flange 11*f* provided with the insertion rod 11*h*, is designed to be the position that catches the lower extremity of the central spring 21 that is to be inserted into the insertion rod 11*h*.

To prevent the releasing of the hooked lock 23C of the mounted slit inner blade 5, the slit type latching windows 11*d* extend up and down at the side faces in the vertical columns 11B of the inner blade stage 11. The locks 23C of the slit inner blade 5 are hooked to the latching windows 11*d* to prevent the slit inner blade 5 mounted in the inner blade stage 11 from coming off easily. But, if the slit inner blade 5 is strongly pulled, the locks 23C of the slit inner blade 5 come off the latching windows 11*d* and the slit inner blade 5 can be separated from the inner blade stage 11.

The central spring 21 is inserted into the insertion rod 11*h* mounted in the inner blade stage 11, and flexibly pushes the slit inner blade 5 and the the up-down stage 11A. The outer blades 2 with slit ports pushed out by the central spring 21, are pushed flexibly to the inner face of the outer blades 2 with slit ports, and efficiently shave the beard penetrating the outer blades 2 with slit ports.

Figure 12:
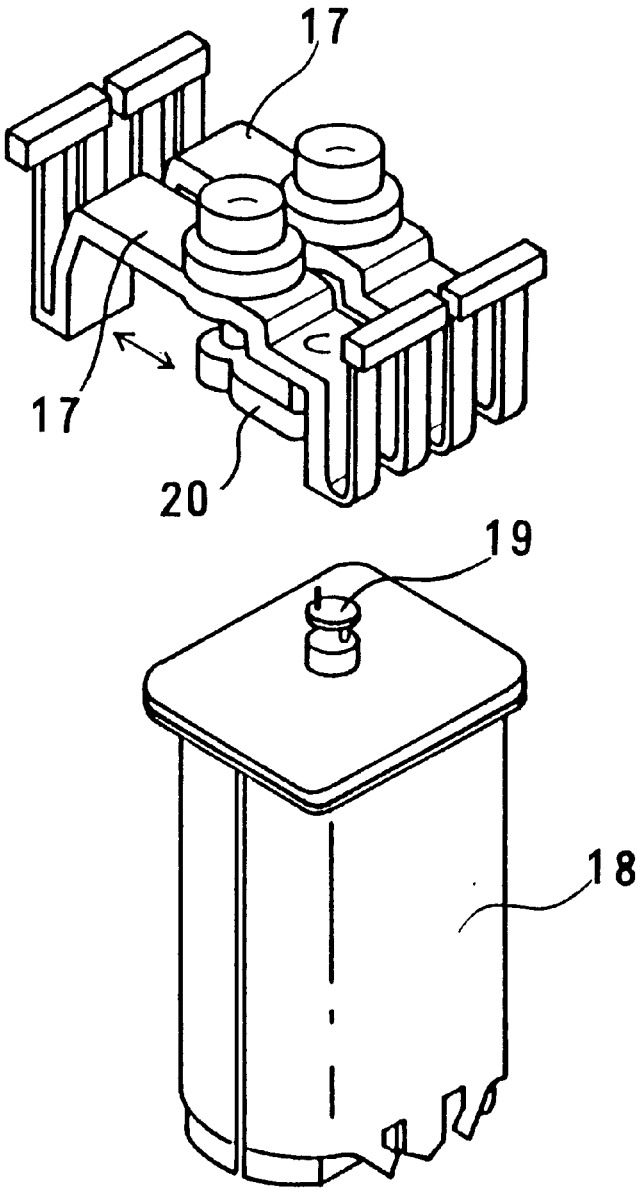
FIG. 12 is an oblique view showing an inner blade stage vibration driving mechanism.

The two inner blade stages 11 that vibrate the arched inner blades 3 and the slit inner blades 5, as shown in FIG. 12, move in opposing reciprocating motions produced by the driving mechanism mounted in the body case. The driving mechanism is provided with the vibrators 17 connecting the inner blade stage, the motor 18 giving a reciprocating motion to these vibrators 17, and the inverter mechanism changing the rotating motion of the motor 18 into a reciprocating motion that moves the vibrators 17 in a reciprocating motion.

The inverter mechanism is provided with the cam shaft 19 fixed to the rotating shaft of the motor 18, and with the connecting rods 20 connecting the eccentric axis of this cam shaft to the vibrators 17. To vibrate in the opposing direction, the two connecting rods 20 are mounted symmetrically compared with the center of the rotating shafts, at the center of the cam shaft. When one connecting rod 20 is moving to the right side, the other connecting rod 20 moves to the left side, giving an opposing reciprocating motion to the inner blade stage 11.

The driving mechanism of this construction, turns the cam shaft 19 by means of the motor 18, and the eccentric shaft of the cam shaft 19 connects to the rods 20, so that the rotating motion is changed reciprocating motion of the vibrators 17. At the center of the vibrators 17, the holes connecting the coupling rods of the inner blade stage 11, are opened vertically. The coupling rods of the inner blade stage 11 are inserted into the holes of the vibrators 17, and the inner blade stage 11 is connected to the vibrators 17.

Figure 14:
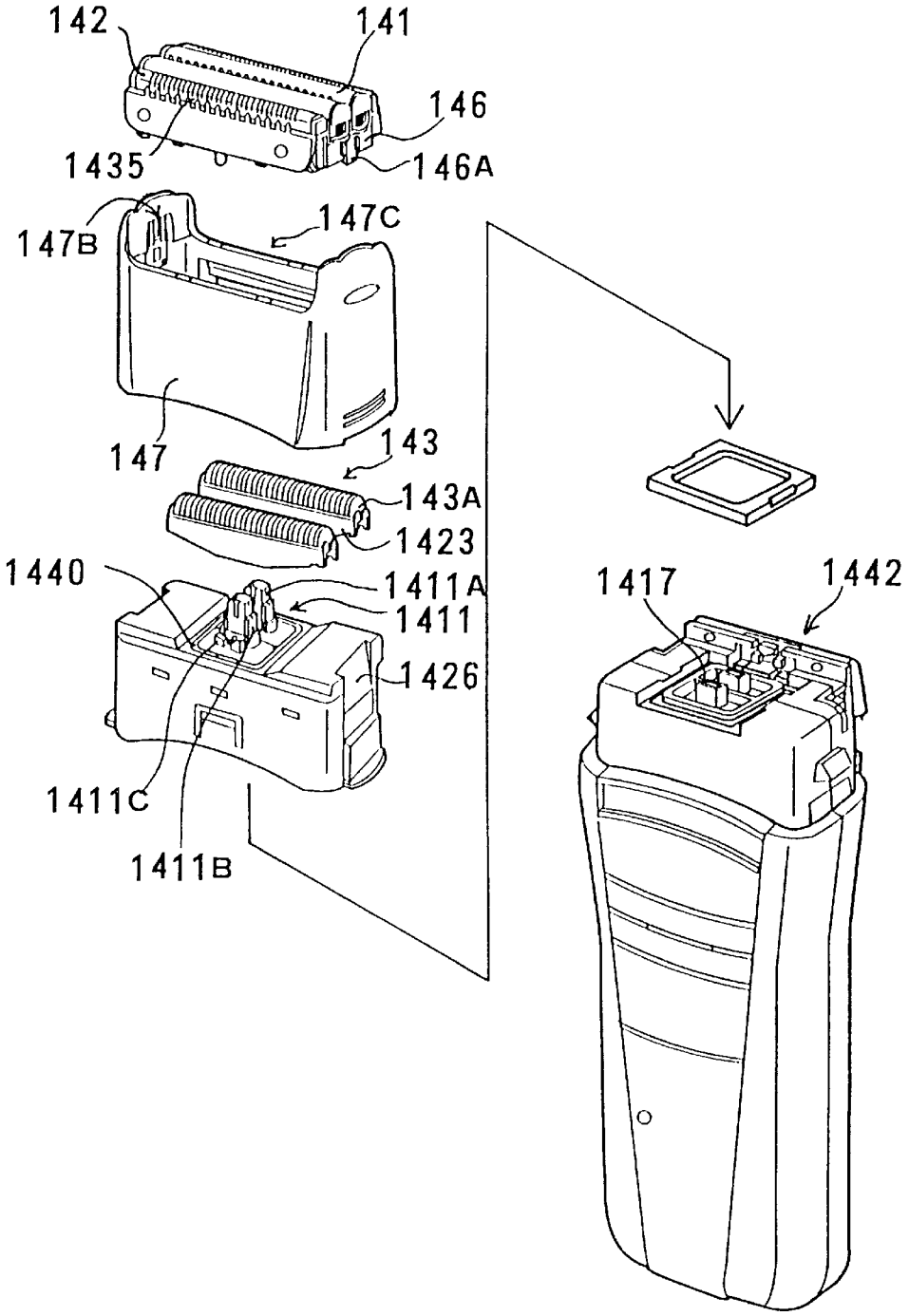
FIG. 14 is an exploded oblique view of the electric shaver of another embodiment of the present invention.

Furthermore, the electric shaver shown in FIG. 14 is provided with a shaver body 1424, an outer blade frame 147 mounted in a removable fashion in this shaver body 1424, and a blade support 1426 connecting inner blades mounted at the inner side of the outer blade frame 147.

Figure 15:
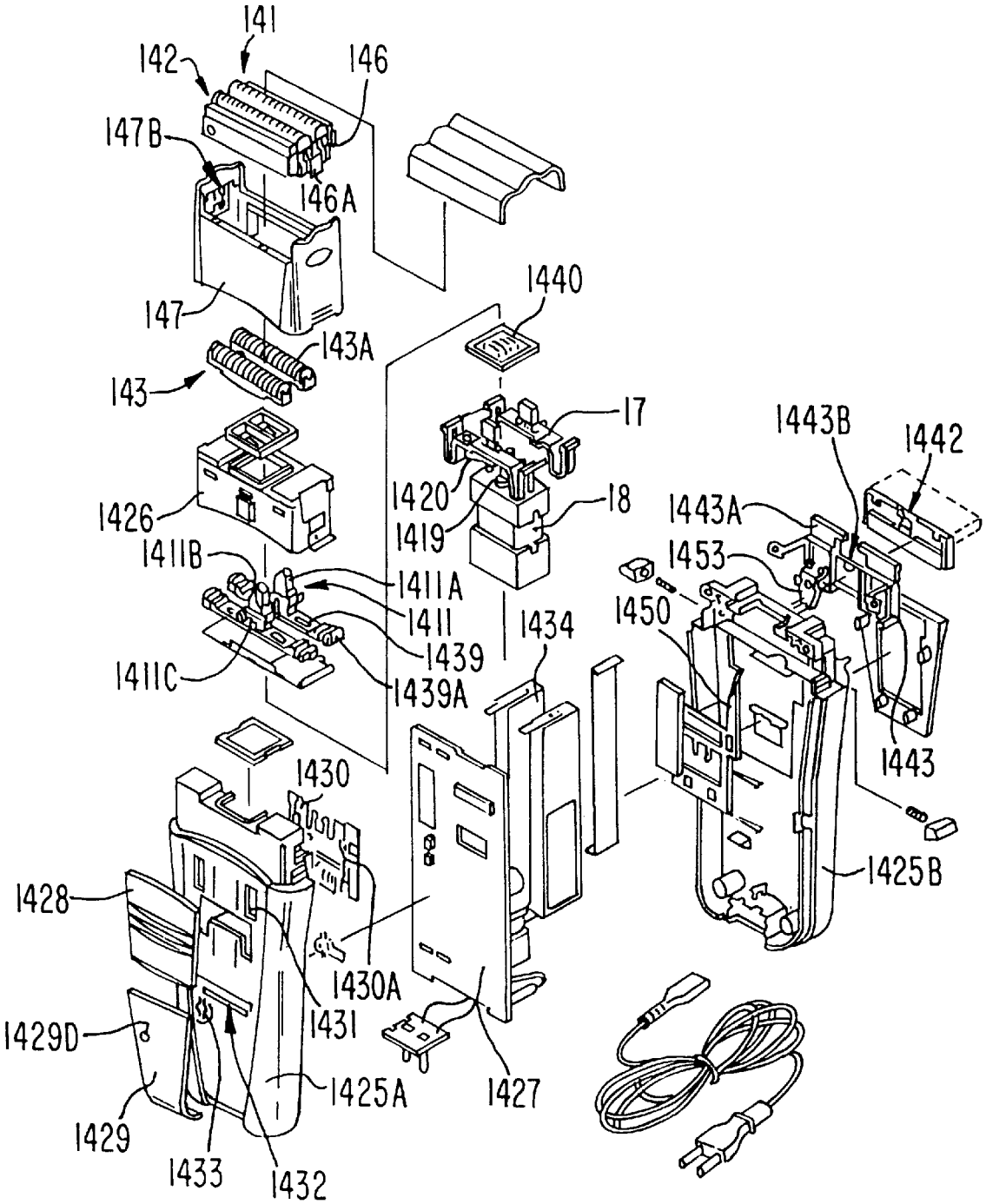
FIG. 15 is an exploded oblique view of the electric shaver shown in FIG. 14.

A driving mechanism including a motor 1418 and a printed circuit board 1427 fixing the electrical circuit parts are mounted in body case 1425 of the shaver body 1424 shown in the exploded oblique view of FIG. 15. The plastic body case 1425 is designed to separate in two parts into an external case 1425A and a back case 1425B. This is not shown in the figure, but the external case 1425A and the back case 1425B are connected by screws located in two vertically spaced places.

According to FIG. 15, the external case 1425A placed at the left side mounts a switch plate 1428 in the front and a decoration panel 1429. In the external case 1425, the mounting part of the switch plate 1428 and of the decoration panel 1429 are made lower to make the surface of the case at the same level as the switch plate 1428 and the decoration panel 1429. The switch plate 1428 is mounted into the external case 1425A so that it can move up and down and the decoration panel 1429 is fixed in the external case 1425A so that it cannot move.

Figure 17:
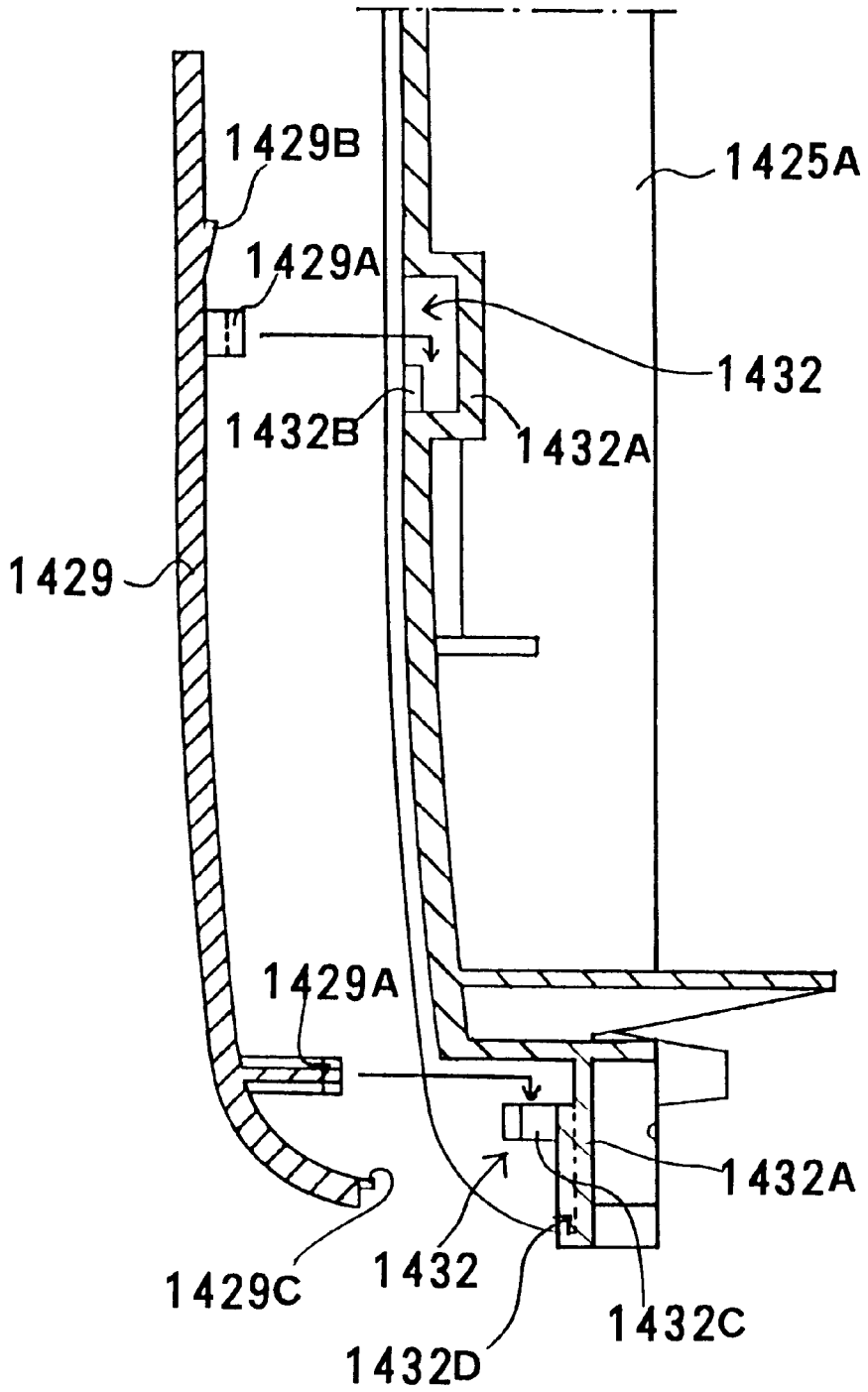
FIG. 17 is a cross-sectional view showing the connecting condition of the decoration panel to the external case of the electric shaver shown in FIG. 16.

The switch plate 1428 is connected to a switch support plate 1430 rubbing the inner face of the external case 1425A. The switch support plate 1430 is made of plastic and is made in one piece with a connecting hook 1430A connecting the back side of the switch plate 1428 through the vertical hole of the external case 1425A. This is not shown in the figure but, the switch plate 1428 is shaped with the latching grooves (not shown in the figure) latching the connecting hooks 1430A in the back. The switch plate 1428 and the switch support plate 1430 connected through the connecting hooks 1430A, rub up and down interposed between each side of the external case 1425A. When the switch plate 1428 moves up and down, the connecting hooks 1430A move in vertical holes 1431. The switch support plate 1430 fixes the switch terminal (not shown in the figure) contacts and rubs the surface of the printed circuit board 1427. When the switch support plate 1430 is raised, the motor 1418 is turned ON and, when lowered, the motor is turned OFF. When the motor 1418 turns, the inner blades move in a reciprocating motion. The decoration panel 1429 is fixed to the external case 1425A connecting a latching piece 1429A in a latching detent 1432. The decoration panel 1429 is made of a plastic plate plated with metal on its surface. But it is also possible to have a decoration panel 1429 totally made of metal. To allow easy understanding of the structure the decoration panel 1429 in the external case 1425A, FIG. 16 shows an oblique view of the decoration panel 1429 with the front and the back inverted. Furthermore, FIG. 17 shows the cross-section of the part connecting the decoration panel 1429 in the external case 1425A. The latching pieces 1429A are shaped in one piece with the decoration panel 1429 shown in these figures, at two places in the upper part and two places in the lower part. The stopper flange 1429B is shaped in one piece protruding upwards at the center of the upper part of the latching piece 1429A. The face of the extremity of the stopper flange 1429B is made oblique, as shown in the cross-section view of FIG. 17, to mate easily with the groove that is the latching detent 1432. The latching piece 1429A of the lower part is provided at the bent part of the decoration panel 1429 bottom. The latching piece 1429A of the lower part is long and protrudes so that it connects the bent part of the bottom of the external case 1425A.

The latching pieces 1429A of the upper and lower parts 1429A are shaped like lateral hooks protruding at their extremities. Furthermore, the insertion plugs 1429C are built in one piece at both sides of the lower extremity of the decoration panel 1429 shown in the figure.

The latching detents 1432 latching the latching pieces 1429A of the decoration panel 1429 are provided at the upper part and lower part of the external case 1425A. The upper latching detent 1432 latches by the groove opened in the front face of the external case 1425A, the bottom of the groove being fixed by the insulating base plate 1432A built in one piece with the external case 1425A. The insulating base plate 1432A closes with no gap the entire bottom face of the groove. But, the insulating base plate can also allow closing to the bottom face of the groove with a slight gap. The groove that is the latching detent 1432, with the flat part of the opening made rectangular, extends vertically with a fixed width. Furthermore, at the lower extremity of the opening, the groove is provided with a latching rib 1432B protruding at the inner side. The latching rib 1432B hooks the latching piece 1429A shaped like a hook. The latching detent 1432 shown in the figure, hooks the latching piece 1429A moved vertically downwards, into the latching detent 1432. For this reason, the latching rib 1432B is provided at the lower extremity of the groove. The groove that latches with the latching detent 1432 by moving the latching piece 1429A vertically upwards, is provided with the latching rib 1432B in the upper extremity of the opening.

The groove that is the latching detent 1432 provided at the lower extremity of the external case 1425A latches the latching piece 1429A of the bottom of the decoration panel 1429. This latching detent 1432 locks the bottom of the groove by the insulating base plate 1432A and is also built in one piece with the latching struts 1432C that hook the latching piece 1429A, protruding from insulating base plate 1432A. The latching struts 1432C are designed like a hook protruding at the inner face to hook the lower extremity of the latching piece 1429A. Furthermore, the lower latching detent 1432 is provided with a mounting ditch 1432D that leads in the insertion plugs 1429C protruding at the bottom of the decoration panel 1429.

As shown by the arrow in FIG. 17, the decoration panel 1429 is moved downward to align with the external case 1425A, and such that the latching piece 1429A hooks in the latching detent 1432 and fixes in the external case 1425A. With the decoration panel 1429 lowered to be fixed to the external case 1425A, the upper and lower latching pieces 1429A are hooked with the upper and lower latching detents 1432, and the insertion plugs 1429C of the bottom of the decoration panel 1429 are introduced into the mounting ditches 1432D. Furthermore, in this condition, to prevent the decoration panel 1429 from moving up and becoming seperated, the stopper flange 1429B is in contact with the upper face of the groove of the upper latching detent 1432. In this condition, the surface of the decoration panel 1429 fixed to the external case 1425A is designed to mate the shape of the external case 1425A and also to beautifully decorated the frontal face of the plated external case 1425A.

Furthermore, the decoration panel 1429 shown in FIG. 16 is opened with the through hole 1429D of the pilot lamp that glows outside. In the inner side of the through hole 1429D, and also in the external case, the through hole 1433 is opened, and inside of this is mounted a pilot lamp like a LED or the like, not shown in the figure. The pilot lamp is fixed on the printed circuit board 1427 built-in in the body case 1425 and set at a fixed position.

The back of the printed circuit board 1427 is approached and mounted in the face of the external case 1425A,as shown in FIG. 15. This is to rub the switch terminal mounted in the switch support plate 1430 that is moved by the switch plate 1428 in a reciprocating motion, against the surface of the printed circuit board 1427. The rechargeable battery 1434 or the electrical parts of the rechargeable battery 1434 that compose the charging circuit of the rechargeable battery 1434 are fixed on the surface of the printed circuit board 1427.

The outer blade frame 147 that is mounted in a removable fashion in the shaver body 1424, mounts the two arched outer blades 141 and the two rows of outer blades 142 with slit ports through the outer blade case 146. The inner blade stage 1411 driven in a reciprocating motion by the driving mechanism of the shaver body 1424, is built-in in the blade holder 1426. This inner blade stage 1411 connects the arched inner blades 143 that rub the face of the arched outer blades 141. The electric shaver shown in FIG. 15, connects the slit inner blades with the outer blades 142 with slit ports. When mounting the blade holder 1426 to the shaver body 1424, the slit inner blades are connected to the inner blade stage 1411 and move in a reciprocating motion.

The characteristic of the electric shaver of this structure is to allow simple and easy extension of the length of the decoration panel with a beautiful metallic surface, and also to allow fixing at an exact fixed position. This electric shaver insulates the latching piece of the decoration panel and the inside of the case by the insulating base plate by making the latching detent mounted in the body case connect to the decoration panel, as the latching groove opened in the case surface and by closing the bottom of this groove by the insulating base plate that is built in one piece with the body case. Especially, the insulating base plate that is built in one piece with the body case, is characterized in that it can insulate with a very high reliability the decoration panel and the inner part of the case, avoiding any movement of the insulating plate placed between the case body and the printed circuit board. Furthermore, because the insulating base plate is fixed at a fixed position when forming the body case, it is not necessary to fix the insulating base plate at a fixed place in the mounting process, and no complicated structure is needed to connect the insulating base plate at a fixed place of the body case of the printed circuit board. For this reason this feature anables a low cost mass production with efficient insulation of the decoration plate and the parts inside the case. Further, the electric shaver of this structure allows easy fixing of the body case moving the decoration plate along the surface of the body case.

Furthermore, the electric shaver mounted with a stopper flange in the back of the decoration panel, to prevent the movement in the releasing direction of the decoration panel, avoids the movement in the direction of the releasing of the decoration panel, in the condition where the decoration panel is fixed at the fixed position of the body case, that is to say in the condition where the latching piece is hooked in the latching detent and the stopper flange is latched in the groove that is the latching detent. The characteristic of the electric shaver of this structure is to allow a safe connection of the decoration panel in the body case by a simple structure.

Figure 18:
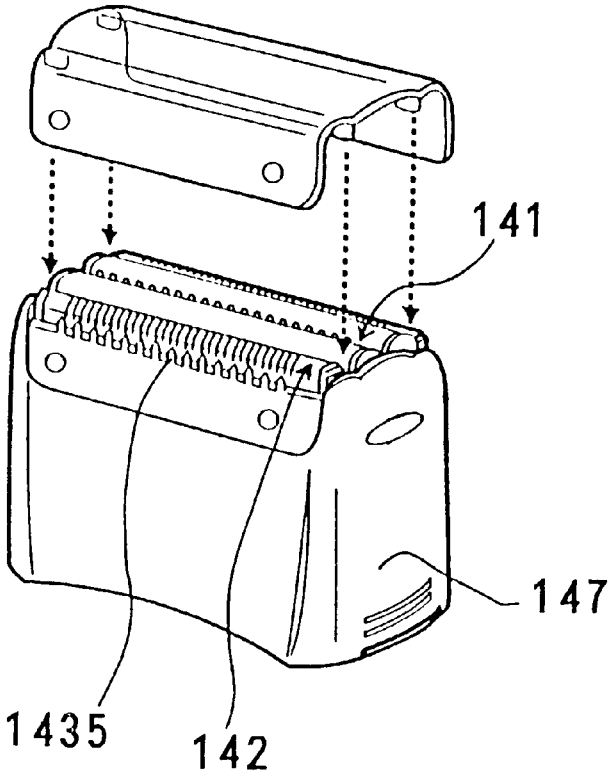
FIG. 18 is an oblique view showing the connecting condition of an outer blade frame and the outer blade case with the outer blades of the electric shaver shown in FIG. 14.
Figure 19:
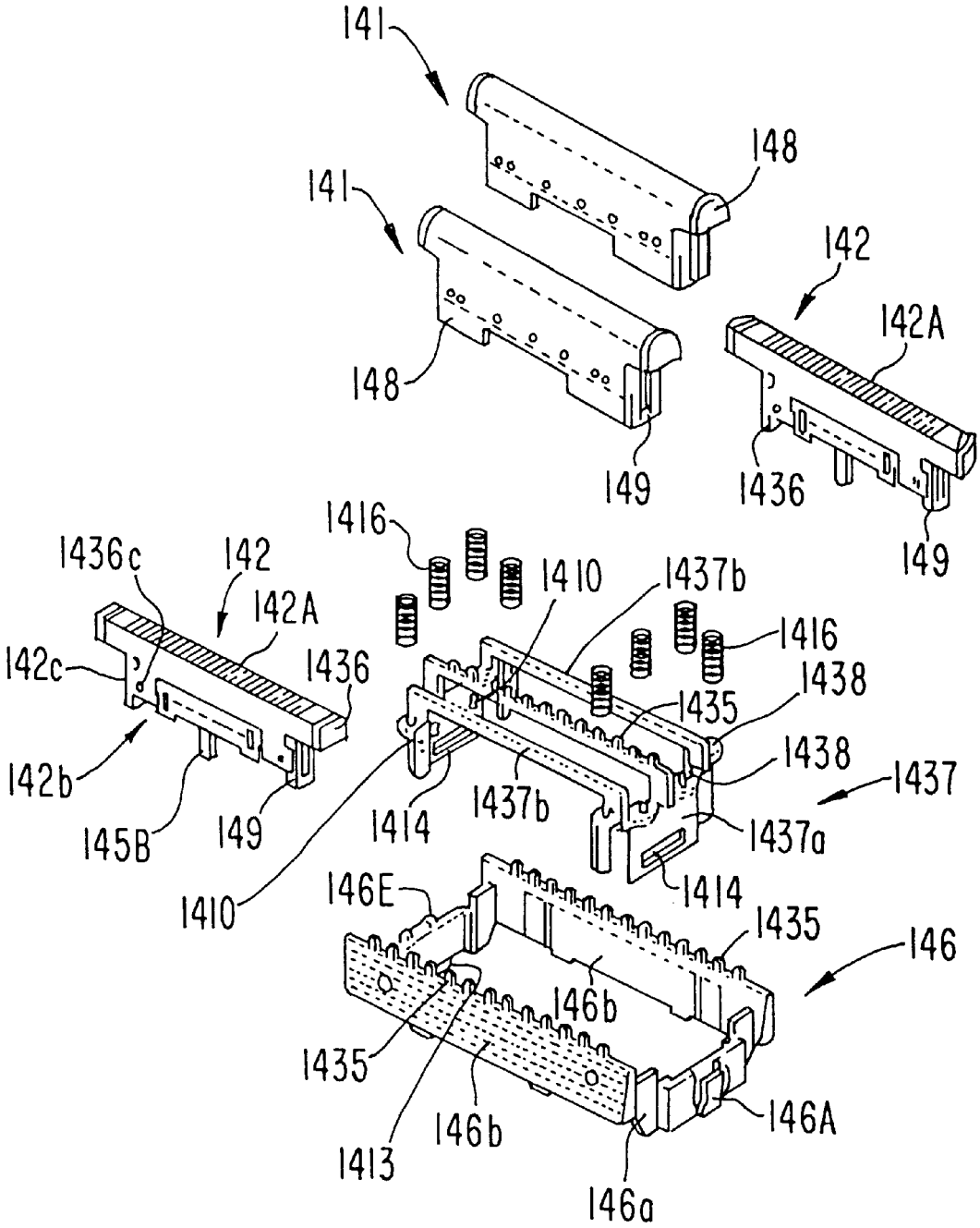
FIG. 19 is an exploded oblique view showing the arched outer blades, the outer blades with slit ports, the central stage and a outer blade case of the electric shaver shown in FIG. 14, in an exploded condition.
Figure 20:
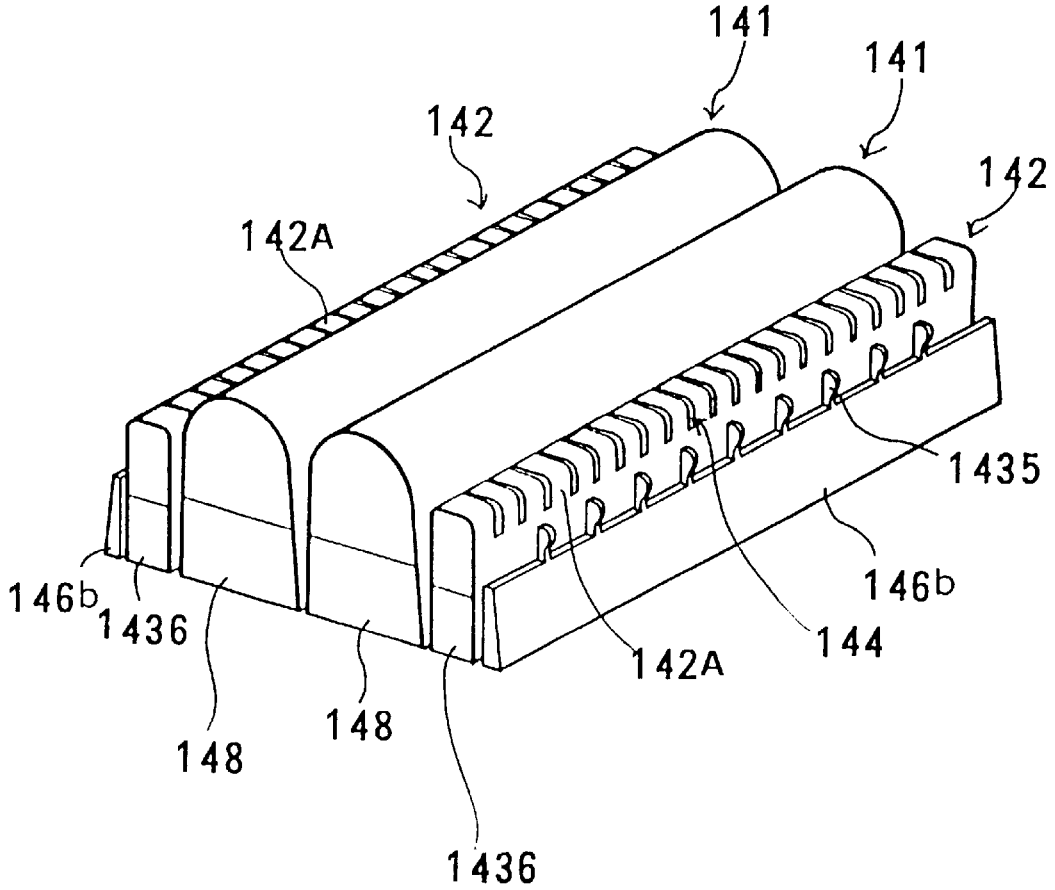
FIG. 20 is an oblique view of the arched outer blades, the outer blades with slit ports and a comb of the electric shaver shown in FIG. 14.

FIG. 18 to FIG. 20 show the parts that are mounted in the upper part of the electric shaver shown in FIG. 14. These Figures are exploded oblique views of the two rows of arched outer blades 141, the two rows of outer blades with slit ports 142, the three rows of combs 1435, the outer blade case 146 mounting the arched outer blades 141 and the outer blades 142 with slit ports in parallel, the outer blade frame 147 mounting in a removable fashion the outer blade case 146, the arched inner blades 143 pushed against the inner face of the arched outer blades 141 and rubbing them, the slit inner blades 145 pushed against the inner face of the outer blades 142 with slit ports and rubbing them, and the inner blade stage 1411 connecting the arched inner blades 143 and the slit inner blades 145.

Figure 21:
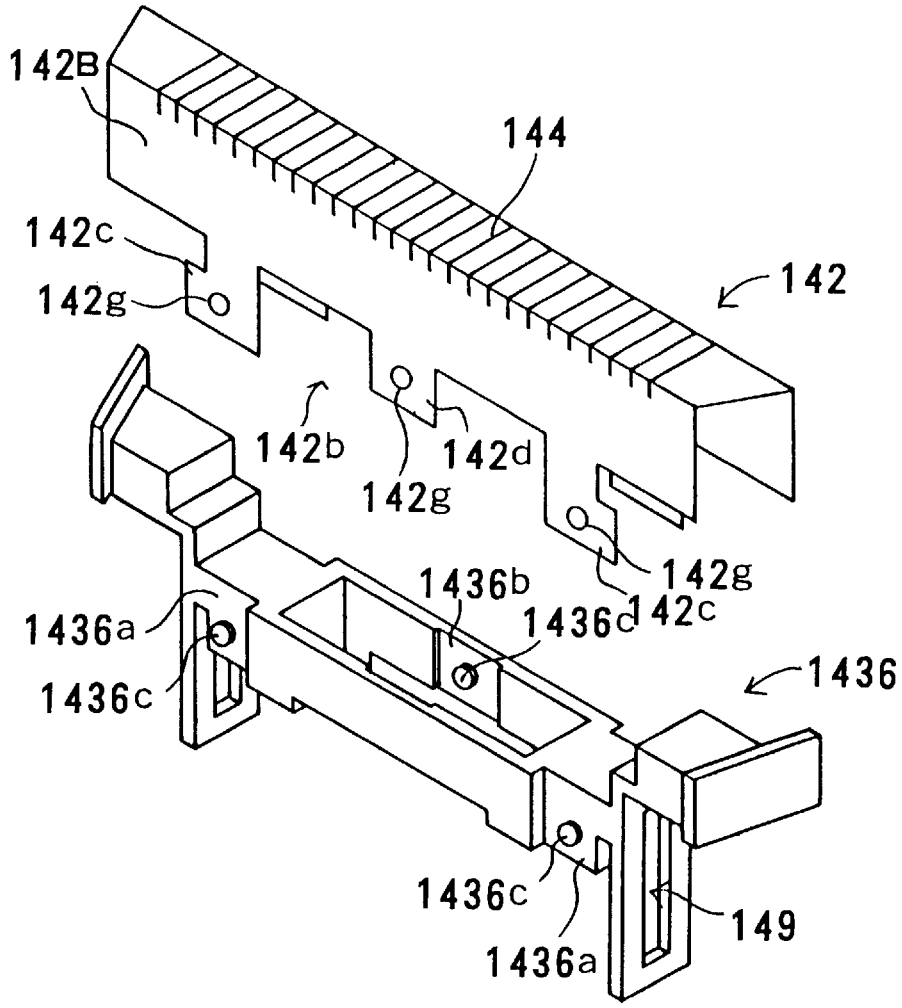
FIG. 21 is an exploded oblique view showing the outer blades with slit ports of the electric shaver shown in FIG. 14.
Figure 22:
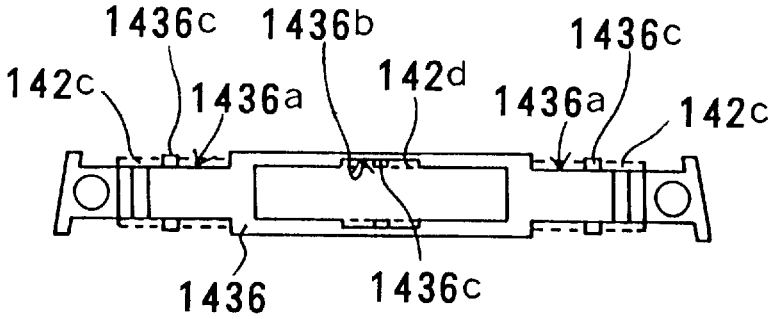
FIG. 22 is a bottom view showing the outer blade support of the outer blades with slit ports shown in FIG. 21.

An exploded oblique view of the outer blade 142 with slit ports is shown in FIG. 21 and the bottom view of the outer blade support 1436 is shown in FIG. 22. The outer blade 142 with slit ports of this figure, connects the slit outer blade 142B with the outer blade support 1436. The outer blade support 1436 is made of a sheet metal and has the shape of a horizontal "U" and is provided with the outer blade support 1436 connecting parts 142*b* at the bottom of each opposing face. The external connecting parts 142*c* connecting the external connecting face 1436*a* mounted in the external faces of the outer blade support 1436, and the internal side connecting part 142*d* connecting the internal connecting face mounted with the inner side of the outer blade support 1436 are provided in the connecting part protruding downwards. The external connecting parts 142*c* are placed at both ends of the slit outer blade plate 142B, and the internal connecting part 142*d* is placed at the center of the slit outer blade plate 142B.

The outer blade support 1436 is a plastic part shaped like a square column. The outer blade support 1436 is designed with the external connecting faces 1436*a* on both faces of each extremity and with internal connecting face 1436*b* on the inner face of the center. Because the external connecting parts 142*c* and the internal connecting part 142*d* are in the same plane in the slit outer blade plate 142B shown in the figure, the external connecting face 1436*a* is designed like a step a little lower to allow the tight fitting of the external connecting parts 142*c* of the slit outer blade plate 142B, and the internal connecting face 1436*b* fits tightly with the internal connecting parts 142*d* and is provided with the step in the internal side to have the internal connecting part 142*d* and the outer blade support 1436 in the same plane.

To avoid releasing of the slit outer blade plate 142B connected in the outer blade support 1436, the through holes 142*g* are provided in the external connecting part 142*c* and in the internal connecting part 142*d*; the latching flanges 1436*c* to be introduced into the through holes 142*g*, are designed protruding from the external connecting faces 1436*a* of the outer blade support 1436 and the internal connecting face 1436*b* of the outer blade support 1436. Through holes 142*g* are provided in both the external connecting parts 142*c* and in the internal connecting parts 142*d*; the structure locking the latching flange 1436*c* of the outer blade support 1436 in both through holes 142*g*, connects extremely surely the outer blade support 1436 in the slit outer blade plate 142B. The latching flanges 1436*c* of the internal connecting face 1436*b* introduced into the through hole 142*g* of the internal connecting part 142*d* protrudes by an amount that does not allow protrusion from the surface of the internal connecting part 142*d*. if it protrudes from the internal connecting part 142*d*, it will catch the inner blade support during the reciprocating motion and a smooth motion will not be achieved. But it is possible to connect the outer blade support in the slit outer blade plate because through holes are provided in the external connecting parts and latching flanges in the external connecting faces; and because through holes are not provided in the internal connecting part and latching flanges are not provided in the internal connecting face. On the contrary, it is also possible to provide the through holes in the internal connecting part, and the latching flanges in the internal connecting face, and to connect the slit outer blade plate in the outer blade support.

When the external connecting parts 142*c* and the internal connecting part 142*d* of the slit outer blade plate 142B are connected to the external connecting faces 1436*a* and to the internal connecting face 1436*b* of the outer blade support 1436, the latching flanges 1436*c* are introduced into the through holes 142*g* and the slit outer blade plate 142B are connected at a fixed position in the outer blade support 1436.

These outer blades with slit ports allow an easy and simple connection of the outer blades with slit ports of the outer blades at a fixed position in the outer blade support. This is because the external connecting parts connected to the external connecting faces provided at the external side of the outer blade support, and the internal connecting part connected to the internal connecting face provided at the internal side of the outer blade support are provided at the connecting parts placed at the lower extremity of each side of the slit outer blade plate, it is possible to connect through a latching structure, the internal connecting part and the external connecting parts of this slit outer blade plate, in the internal connecting face and in the external connecting faces of the outer blade support. The slit outer blade plate connected at the internal side and at the external side of the outer blade support is connected to the outer blade support so that it catches in the outer blade support from inside and outside. For this reason, the slit outer blade plate is connected to the outer blade support without being able to move inward or outward.

Therefore, the slit outer blade plate can be easily introduced and connected at a fixed position of the outer blade support. Furthermore, in these outer blades with slit ports, because the external connecting part and the internal connecting part of the slit outer blade plate are connected to the external connecting face and to the internal connecting face of the outer blade support by the locking structure, and after having mounted the slit outer blade plate at a fixed position of the outer blade support, it is not necessary to heat, melt and press the connecting flanges. For this reason the characteristic is that no device is needed to heat and melt the plastic and that the slit outer blade plate can be surely introduced and connected to the outer blade support.

Especially, the characteristic is that in these outer blades with slit ports, in the condition where both faces of the outer blade support are kept latched by the external connecting parts and the internal connecting part of the slit outer blade plate, because the slit outer blade plate is connected in the outer blade support, by making a locking structure to prevent the releasing of the slit outer blade plate and of the outer blade support, it is possible to connect surely the slit outer blade plate in the outer blade support in the condition where the latching part does not release. Especially, the structure providing through holes in the connecting part of the slit outer blade plate, and introducing the latching flanges of the outer blade support in these through holes, the feature is that the slit outer blade plate can be surely connected to the outer blade support. By introducing the latching flanges in the through holes, the characteristic is that the slit outer blade plate is connected at a more precised location.

Then, in an electric shaver with the external connecting parts and the internal connecting part of the slit outer blade plate in the same plane, the slit outer blade plate can be easily mass produced with a high efficiency by embossing. The outer blade support made of plastic can be easily shaped with the external connecting faces and the internal connecting face in the position connecting the external connecting parts and the internal connecting part.

Furthermore, the characteristic of the electric shaver provided with the external connecting parts at both extremities of the slit outer blade plate and with the internal connecting part at the center, is that it can allow a smooth reciprocating motion of the inner blade support by the internal part of the outer blade support, preventing by the central internal connecting part, the central part of the outer blade support from bending inwards.

The two rows of outer blades 142 with slit ports, together with the arched outer blades 141, are mounted as shown in the exploded oblique view of FIG. 19, in the outer blade case 146 through the central stage 1437 to allow their independent vertical motion, that is to say the in and out motion. The outer blades 142 with slit ports are mounted at the external side parallel and close to the two rows of arched outer blades 141. The arched outer blades 141 are mounted so that they protrude out more than the outer blades 142 with slit ports, when they are in the pushed out condition. This is to enable the clean shaving of the beard with the arched outer blades 141 precisely pressed against the skin.

The arched outer blades 141 and the outer blades 142 with slit ports are flexibly pressed towards the skin by the extremity spring 1416 that is a coil spring. With a large stroke, the extremity springs 1416 press the arched outer blades 141 and the outer blades 142 with slit ports against the skin. When the arched outer blades 141 and the outer blades 142 with slit ports that are flexibly pushed out from the outer blade case 146, in the condition where they are pushed out by the extremity springs 1416, as shown in FIG. 14 and FIG. 18, the arched outer blades 141 protrude more than the outer blades 142 with slit ports, but when the arched outer blades 141 and the outer blades 142 with slit ports are totally pushed down, the arched outer blades 141 sink deeply until they reach the same plane as the outer blades 142 with slit ports allowing cutting of the beard with the four rows of outer blades 142 with slit ports and arched outer blades 141.

The arched outer blades 141 and the outer blades 142 with slit ports are mounted in the outer blade case 146 so that they can move up and down.

The central stage 1437 mounting the arched outer blades 141 and the outer blades 142 with slit ports in the outer blade case 146, is fixed tightly at the inner side of the outer blade case 146. A central stage 1437 is a plastic part made in one piece with flexible plates 1437*a* placed at both extremities and three connecting rods 1437*b* connecting these flexible plates 1437*a*. The inner faces of the flexible plates are mounted with the guide projections 1410 connecting the arched outer blades 141 and the outer blades 142 with slit ports.

The shape of the external sides of the flexible plates 1437*a* is designed to fit tightly with the inner faces of both extremities of the outer blade case 146. The lower extremities of the flexible plates 1437*a* lead the locking projections 1413 of the outer blade case 146 and have the locking holes 1414 that prevent the releasing of the central stage 1437 from the outer blades case 146. Furthermore, the upper face of the flexible plates 1437*a* is provided with the protruding connecting pins 1438 introducing the extremity spring 1416.

The connecting rods 1437*b* are shaped like thin plates, placed between the four rows of the outer blades and connected at three places on the upper face of the flexible plate 1437*a*. The connecting rod 1437*b* of the center of the flexible plate 1437*a* protrudes more upwards than the connecting rods 1437*a* of both sides, and its upper face has a comb like design.

The outer blade case 146 is composed of extremity plates 146*a* at both extremities and of lateral plates 146*b* connecting both extremities of these extremity plates 146*a*. The outer blade case 146 composed of the extremity plates 146*a* and of the lateral plates 146*b* is a square plastic part made in one piece. The outer blade case 146 is designed square to fit tightly with the central stage 1437 at the inner side.

To allow the connection of the central flexible plate 1437*a* a ditch 146E has been designed to narrow the opening; then the center flexible plate 1437*a* is designed to be introduced in this ditch 146E. In this condition, the central flexible plate 1437*a* that is connected to the extremity plate 146*a*, can be fixed without moving right or left.

The characteristic of this structure is to allow not only simple and easy but also rapid connection of both arched outer blades and outer blades with slit ports in the outer blades case. This is because it connects the arched outer blades and the outer blades with slit ports in the outer blade case through the central stage. Especially, when mounting the arched outer blades and the outer blades with slit ports, because the central stage is in the state where the flexible plate that can flexible open widely this space is connected by the connecting rod, in the condition where the central stage is not connected with the outer blade case, it is extremely easy to mount both of the arched outer blades and the outer blades with slit ports in the central stage. The central stage mounted with the arched outer blades and the outer blades with slit ports, mounted into the outer blade case, prevents the flexible plates from becoming wide open. For this reason, the characteristic is that the arched outer blades and the outer blades with slit ports mount easily through the central stage and are connected in the outer blade case without releasing.

Furthermore, the particularities of solving the drawback of damaging the connecting part when mounting and also of allowing mass production with high efficiency have been realized because this structure allows mounting of three rows of outer blades naturally in the central stage and in the outer blade case.

Then, the structures having the central stage and the outer blade case made of other material, the central stage and the outer blade case made of plastic of different colors, one part being nicely designed and exposed outside, or made of a different row material, for example the central stage made of easily flexible plastic and the outer blade case made of hard plastic are features that can be realized to mount the arched outer blades and the outer blades with slit ports in an ideal condition.

Furthermore, the electric shaver that mounts in a freely removable fashion the arched outer blades and the outer blades with slit ports in the central stage has the feature to allow the connection of the arched outer blades and the outer blades with slit ports with a large stroke in a smooth removable fashion because it connects the arched outer blades and the outer blades with slit ports in the central stage through the extremity springs.

Then, the characteristic of the electric shaver with the arched outer blades as center outer blades and with outer blades with slit ports as lateral outer blades, is that it reliably cuts the vicious beard etc. with the outer blades with slit ports and finishes nicely the shaving with the arched outer blades.

Especially, the electric shaver with two rows of arched outer blades and two rows of outer blades with slit ports has the feature to shave the beard including various vicious beards nicely with a high efficiency.

The upper face of the lateral plate 146*b* is provided with a comb 1435. The intervals of the comb 1435 have been designed to be wider than the intervals of the parallel slits 144 of the outer blades 142 with slit ports. This is to allow free introduction of the vicious beard in between. Furthermore, the comb 1435 shown in FIG. 23, protrudes with its external part curved outwards. The characteristics of the comb 1435 of this type are that it gently contacts the skin H under optimal conditions when applied in an oblique posture, that its protruding part arranges efficiently the vicious beard K that is attracted into the outer blades 142 with slit ports.

Figure 24:
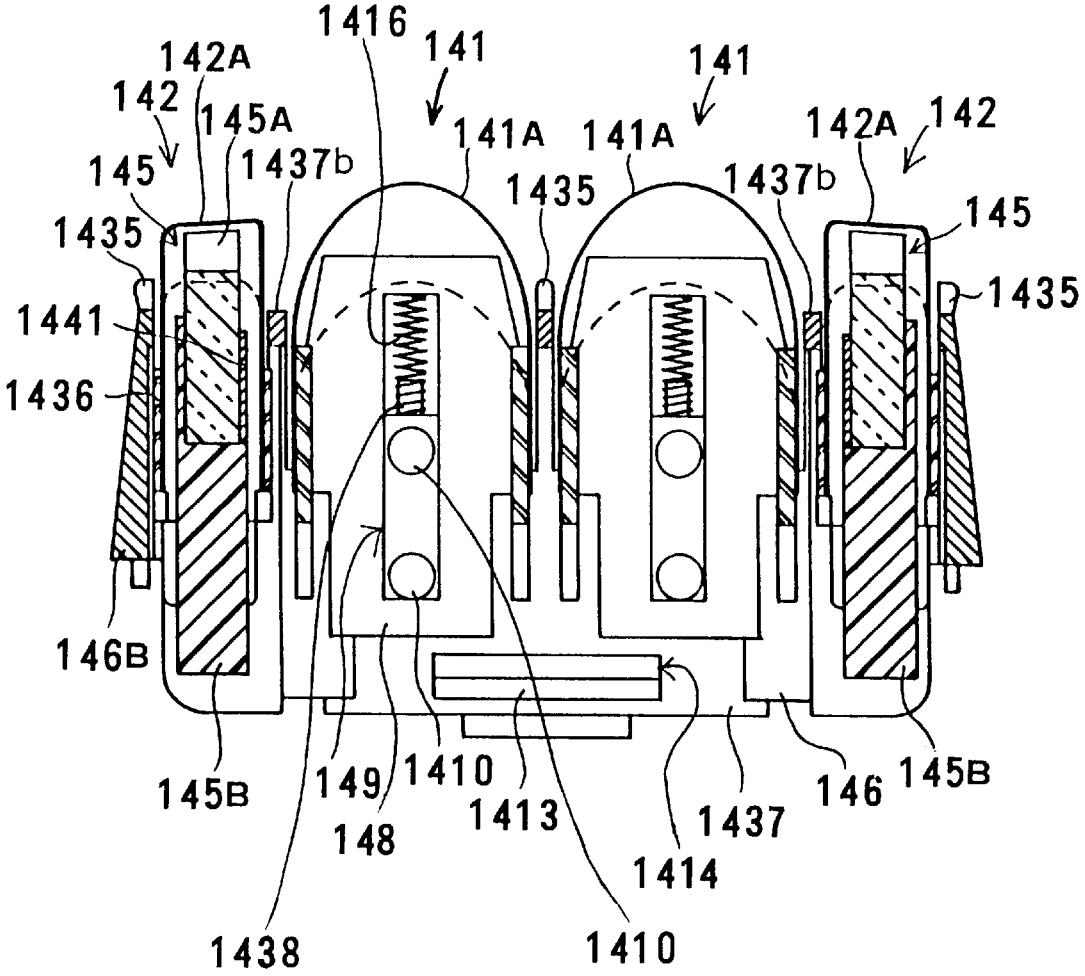
FIG. 24 is a cross-sectional view showing the mounting condition of the arched outer blades and the outer blades with slit ports in the outer blade case through the central stage, of the electric shaver shown in FIG. 14.

The position of the comb 1435, as shown in full lines in FIG. 24, is lower than the upper face of the outer blades 142 with slit ports, in the condition where the outer blades 142 with slit ports are pushed out by the extremity springs 1416 that is to say when the outer blades 142 with slit ports do not press on the skin. When the outer blades 142 with slit ports are pressed against the skin, when it is pressed to the maximum, the upper extremity of the comb 1435 is on the same plane as the upper face of the outer blades 142 with slit ports as shown with the dotted line of the figure. When the arched outer blades 141 are in the pressed condition, they are in the same plane as the outer blades 142 with slit ports and when they are not pressed they protrude from the outer blades 142 with slit ports. For this reason, the arched outer blades 141 and the outer blades 142 with slit ports are mounted in a removable fashion in a position where they protrude more than the comb 1435, when the arched outer blades 141 and the outer blades 142 with slit ports are pressed downward to the maximum extent they are in the same plane as the comb 1435.

Figure 25:
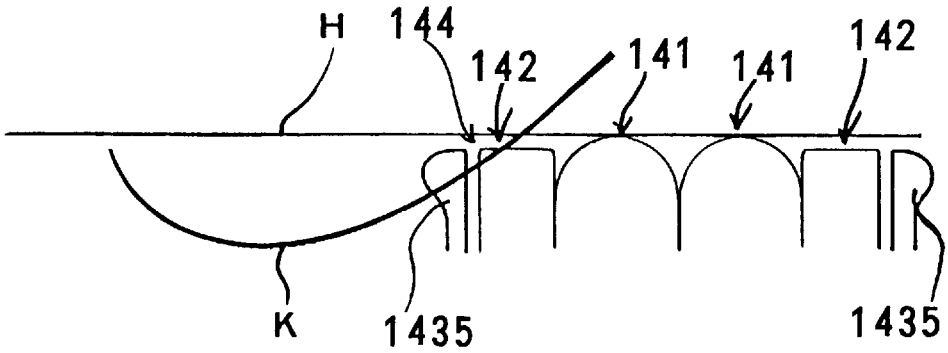
FIG. 25 is a cross-sectional view showing the cutting condition of the vicious beard by the outer blades with slit ports of the electric shaver shown in FIG. 14.
Figure 25:
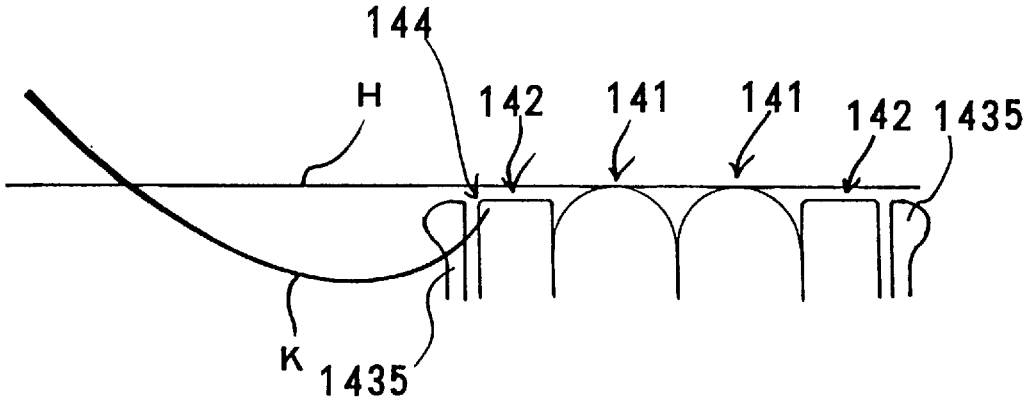

With the electric shaver of this structure, the comb 1435 moves towards the vicious beard K preceding the arched outer blades 141 and the outer blades 142 with slit ports, as shown in FIG. 25, the moving comb 1435, in the condition where the outer blades 142 with slit ports and the arched outer blades 141 do not press on the vicious beard K, in other words in the condition where the vicious beard K bent in the shape of an arch protrudes from the skin H, arranges its direction to be led into the parallel slits 144 of the outer blades 142 with slit ports. The vicious beard K that has been arranged in the direction of the parallel slits 144, is rapidly led into the parallel slits 144 of the outer blades 142 with slit ports. Even in this condition, like the electric shaver of the prior art, the vicious beard K is not pressed by the arched outer blades 141 and can freely change direction, the direction is also arranged by the parallel slits 144 of the outer blades 142 with slit ports using a comb. On the contrary, when the outer blades 142 with slit ports are mounted in the direction where the vicious beard K sprouts, the vicious beard K passes through the intervals of the comb 1435 and is introduced into the parallel slits 144 of the outer blades 142 with slit ports. At this moment, the vicious beard K that can freely change direction, can be lifted up and separated from the skin H and can be more precisely introduced into the parallel slits 144 and precisely cut by the outer blades 142 with slit ports. Furthermore, the vicious beard K that sprouts parallel with the comb and the outer blades with slit ports, not shown in the figure, is aligned in the direction of the parallel slits 144 of the outer blades 142 with slit ports by the moving comb 1435 like the vicious beard K shown in FIG. 25, and is Introduced into parallel slits 144. Therefore, the vicious beard K of that direction also can be precisely cut by the outer blades 142 with slit ports.

Furthermore, in an electric shaver mounted in a removable fashion with the arched outer blades 141 and the outer blades 142 with slit ports in a position where they protrude more than the comb 1435, and mounted so that the arched outer blades 141 and the outer blades 142 with slit ports are in the same plane as the extremity of the comb 1435 when they are in their lowest position, the comb 1435, the outer blades 142 with slit ports and the arched outer blades 141 are in contact with the skin H and cut the vicious beard K most efficiently.

Furthermore, the electric shaver designed with the intervals of the comb 1435 larger than the intervals of the parallel slits 144 of the outer blades 142 with slit ports, can arrange the vicious beard K more precisely in the direction of the introduction into the comb 1435.

Then, the electric shaver mounted with two rows of arched outer blades 141 and with outer blades 142 with slit ports mounted on both sides of the arched outer blades 141 and with the comb 1435 on both sides of the outer blades 142 with slit ports, can cut the vicious beard K with a high efficiency moving in both directions, because both sides of the arched outer blades 141 are symmetrical. And, the electric shaver with the extremity part of the comb 1435 curved and protruding outwards, gives a comfortable touch to the skin and introduces efficiently introduces the vicious beard or others into the outer blades 142 with slit ports.

The arched outer blades 141, the outer blades 142 with slit ports, the central stage 1437, the outer blade case 146, and the outer blade frame 147 shown in FIG. 19 and FIG. 20 are assembled as follows.

① The arched outer blades 141 and the outer blades 142 with slit ports mount in the central stage 1437. At this moment, the central stage 1437 is not connected to the outer blade case 146. Introducing the up-down slits 149 in the guide projections 1410, the arched outer blades 141 and the outer blades 142 with slit ports mount in the central stage 1437. At this moment, the lower part of the flexible plate 1437*a* is widened outwards and the up-down slits 149 are introduced into the guide projections 1410.

② The central stage 1437 mounted with the arched outer blades 141 and the outer blades 142 with slit ports, mounts in the outer blade case 146. The central stage 1437 is connected at a fixed position by the introduction of the locking projections 1413 of the outer blade case 146 in the locking holes 1414.

③ The outer blade case 146 that mounts the arched outer blades 141 and the outer blades 142 with slit ports via the central stage 1437, mounts in the opening 147C of the outer blade frame 147. The outer blade case 146 mounted in the outer blade frame 147, mounts in the outer blade frame 147 in a manner not allowing easy releasing by the introduction of the latching piece 146A in the latching detent 147B.

Figure 23:
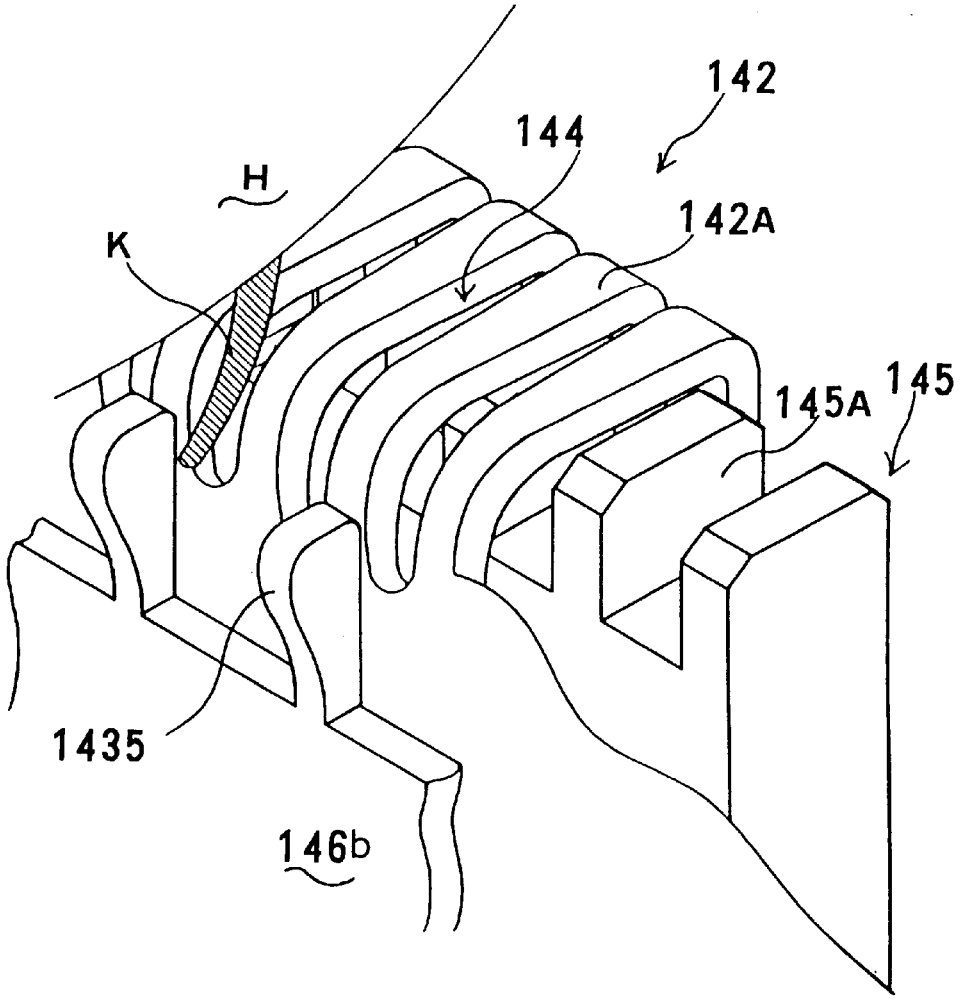
FIG. 23 is an oblique view showing the cutting condition of the beard led into the parallel slits, by the comb, the outer blades with slit ports and the slit inner blades of the electric shaver shown in FIG. 14.

As shown in FIG. 23, the slit inner blades 145 are made of a metallic blade 145A provided with comblike slits. The upper face of the metallic blade 145A rubs against the inner face of the parallel blades 142A and cuts the beard that is led into the parallel slits 144 of the parallel blades 142A.

Figure 26:
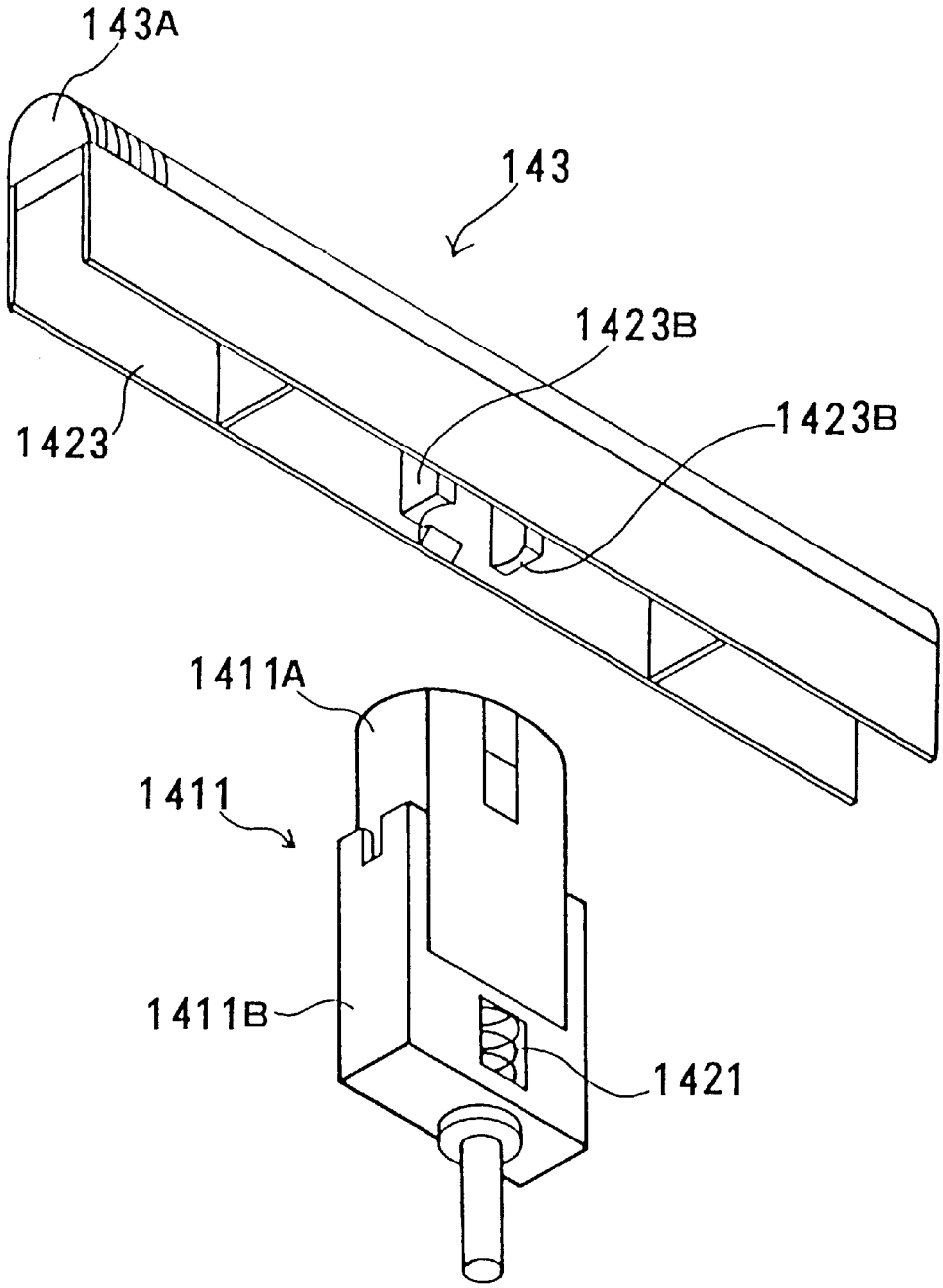
FIG. 26 is an oblique view showing the connecting condition of the arched inner blades to the blade stage of the electric shaver shown in FIG. 14.

The arched inner blade 143 mounts in one piece one pair of connecting support struts 1423B as shown in FIG. 26, in a plastic support 1423 receiving the blade plate 143A. The connecting support struts 1423B are connected to the inner blade stage 1411 via the up-down stage 1411A. The up-down stage 1411A is connected in a removable fashion in the inner blade stage 1411. Because the connecting support struts 1423B are inserted in the up-down stage 1411A, the intervals of the external side are almost the same as the intervals of the internal side of the up-down stage 1411A.

The up-down stage 1411A pressed by the central spring 1421 that is a coil spring, is connected to the vertical column 1411B of the inner blade stage 1411 in a manner allowing up-down motion. Therefore, as shown in FIG. 27, the up-down stage 1411A is connected to the inner blade stage when flexibly pushing the central spring 1421.

Figure 28:
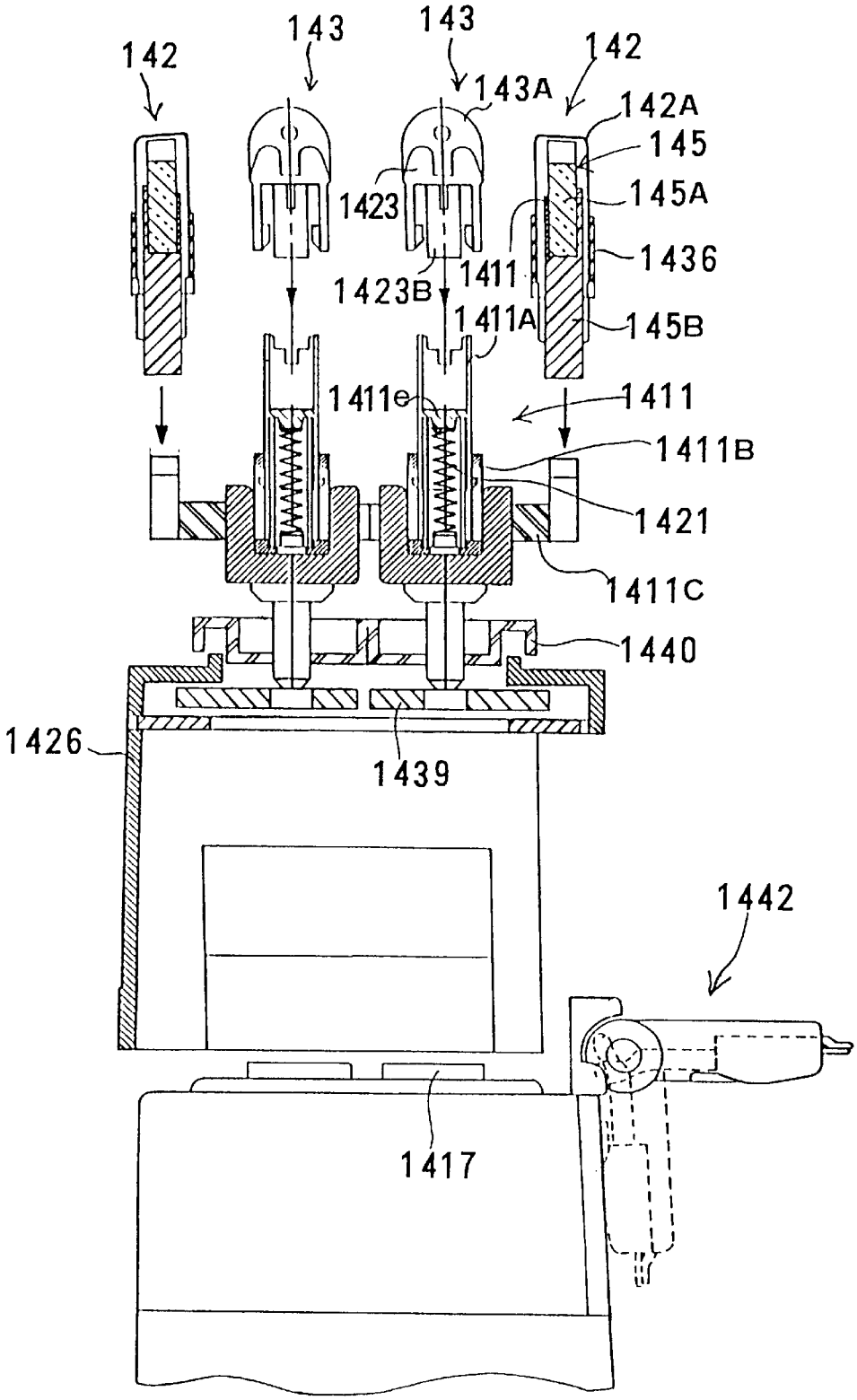
FIG. 28 is a partial cross-sectional lateral view showing the connecting condition of the arched outer blades and the outer blades with slit ports to the inner blade stage of the electric shaver shown in FIG. 14.

The up-down stage 1411A is connected to the inner blade stage 1411 in a manner allowing up-down motion but not releasing. The up-down stage 1411A designed like a square column to hold the central spring 1421 as shown in FIG. 28, is provided at the center with the base plate 1411*e* that presses the upper edge of the built-in central spring 1421. The lower face of the base plate 1411*e* is shaped like a protuberance to introduce the upper extremity of the central spring 1421.

Figure 29:
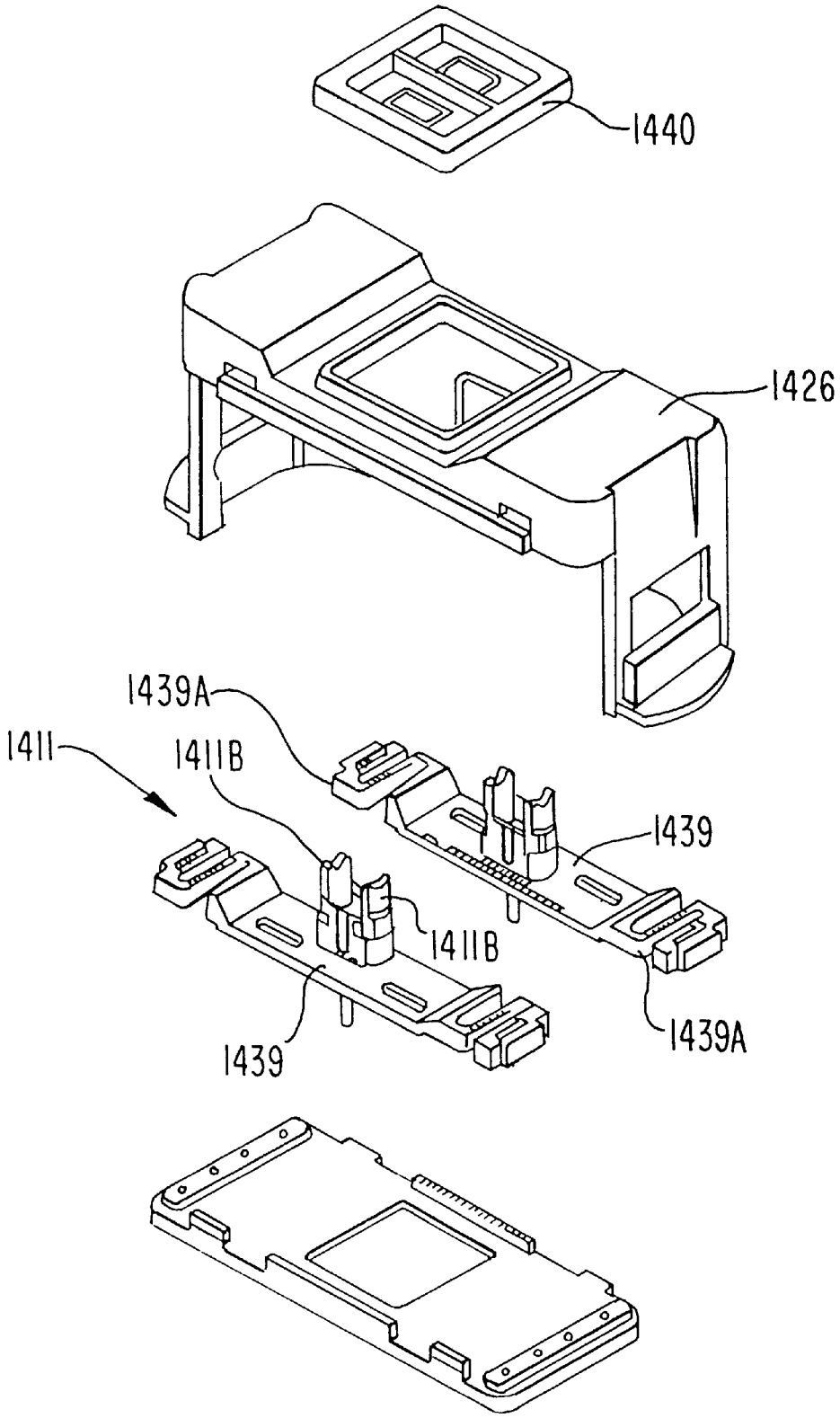
FIG. 29 is an oblique view showing the connecting condition of the inner blade stage to the blade support through the vibrator support, of the electric shaver shown in FIG. 14.

The inner blade stage 1411 is connected as shown in FIG. 29 to the blade support 1426 via the vibrator support 1439. The vibrator support 1439 having flexible arms 1439A flexibly deformable at both extremities, connects the extremity of these flexible arms 1439A to the blade support 1426. The flexible arms 1439A connect the vibrator support 1439 in a manner allowing horizontal vibrations, in the blade support 1426.

Figure 27:
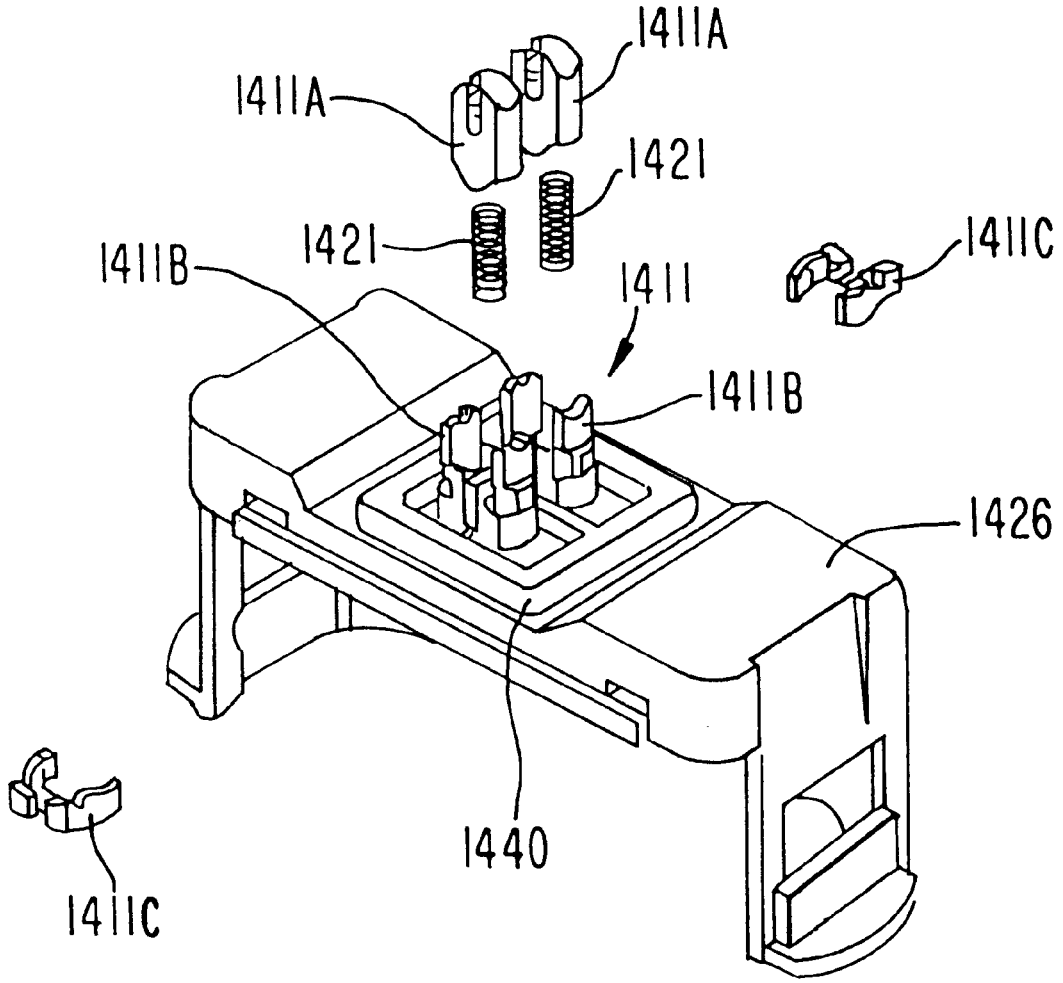
FIG. 27 is an oblique view showing the connecting condition of the inner blade stage to a blade support of the electric shaver shown in FIG. 14.

The inner blade stage 1411 shown in FIG. 27 and FIG. 28 connects the plastic driving piece 1411C that moves the slit inner blades 145. The driving piece 1411C has the inserting arm that inserts flexibly the inner blade stage 1411. Furthermore, the driving piece 1411C has the connecting latch groove that introduces and connects the lower extremity of the slit inner blade 145. Having connected the vibrator support 1439 to the blade support 1426, the driving piece 1411C connects in the inner blade stage 1411 after having mounted the packing 1440 in the space between the vibrator support 1439 and the blade support 1426. The inner blade stage 1411 of this structure allows easy mounting of the packing 1440. This is because the driving piece 1411C does not protrude from the inner blade stage 1411 when the packing 1440 is mounted.

The slit inner blades 145 vibrate in the inner blade stage 1411 via the driving piece 1411C. The slit inner blades 145 mount in the outer blades 142 with slit ports, the outer blades 142 with slit ports are mounted in the central stage 1437 and the slit inner blades 145 are also mounted in the central stage 1437. The slit inner blades 145, like the arched inner blades 143, are not mounted in the inner blade stage 1411. The slit inner blades 145 are provided at a fixed position mounted in the central stage 1437 through the outer blades 142 with slit ports.

Figure 30:
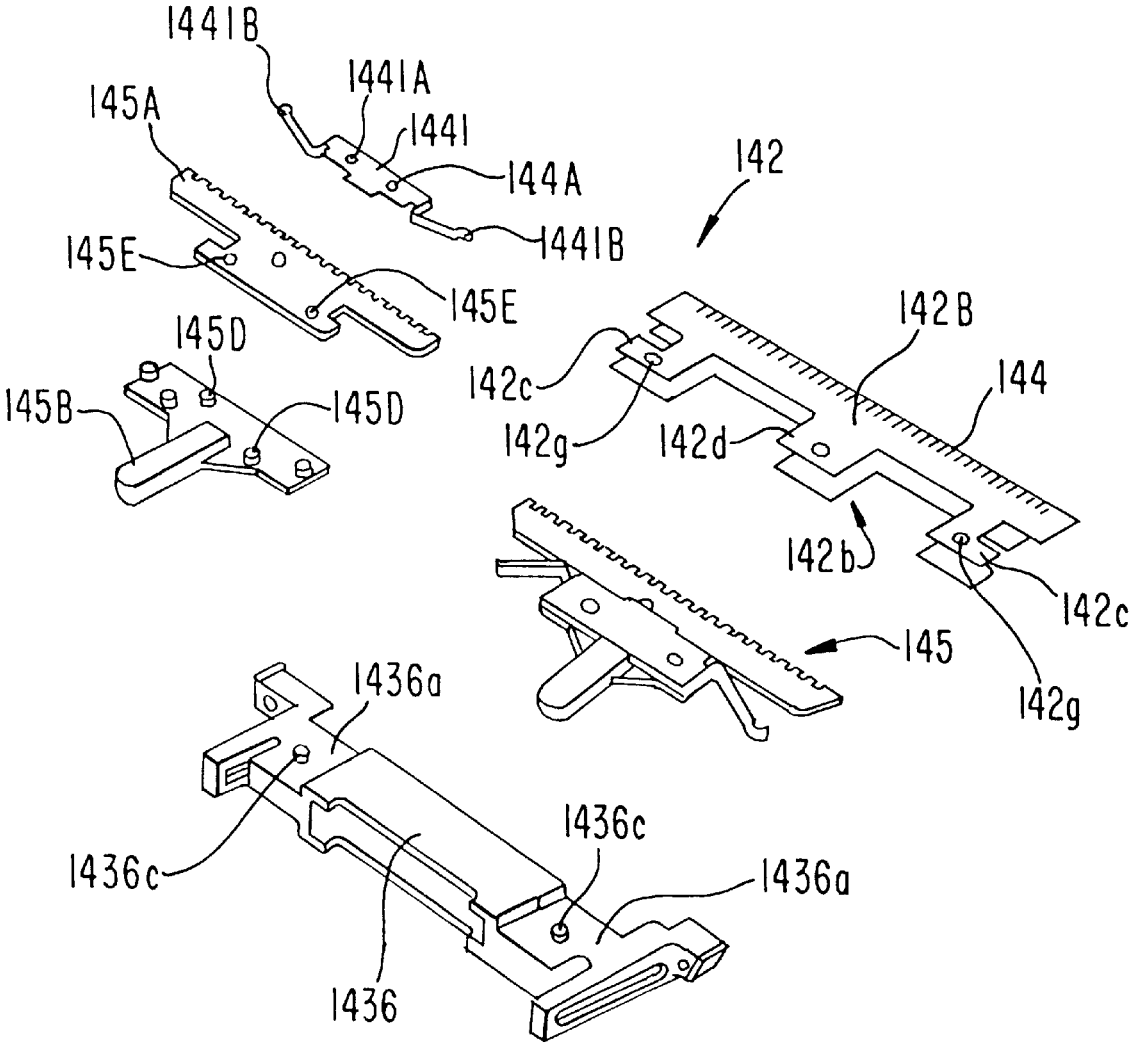
FIG. 30 is an exploded oblique view showing the connecting structure of the slit inner blades and the outer blades with slit ports of the electric shaver shown in FIG. 14.

The connecting structure of the outer blades 142 with slit ports and the slit inner blades 145 is shown in the exploded oblique view of FIG. 30. The slit inner blades 145 of this figure are provided with the metallic blades 145A, the plastic inner blade supports 145B and the blade pushing springs 1441. The metallic blades 145A and the blade pushing springs 1441 are laminated and fixed in the inner blade supports 145B. The inner blade supports 145B designed with a "T" global shape are provided with several protuberances at fixed places of the upper side external face to connect the metallic blades 145A and the blade pushing springs 1441. The metallic blades 145A are provided with the connecting ports 145E at the places connecting the protuberances 145D of the inner blade support 145B.

The blade pushing springs 1441, made of a pressed flexible thin metallic sheet, are provided with the connecting holes 1441A at the places introducing the protuberances 145D of the inner blade support 145B, and the flexible pieces 1441B protrude from each side with an oblique wing shape. The flexible pieces 1441B push the upper face of the inner blade support 145B of the outer blade 142 with slit ports, and metallic blade 145A pushes flexibly the inner face of the outer blade 142 with slit ports.

The slit inner blade 145 shown in this figure connects easily at a precise position the metallic blade 145A and the blade pushing spring 1441 in the upper part of the inner blade support 145B introducing each connecting hole 145E and 1441A in the protuberances 145D. In this condition, the metallic blade 145A and the blade pushing spring 1441 are more surely connected to the inner blade support 145B by heating and flattening out the extremity of the protuberances 145D of the inner blade support 145B. The T-shaped inner blade support 145B connected with the metallic blade 145A and the blade pushing spring 1441 introduces the rod part extended downwards into the outer blade support 1436 of the outer blades 142 with slit ports and connects to the outer blades 142 with slit ports.

After having been introduced into the outer blade support 1436 of the outer blades 142 with slit ports, the inner blade support 145B connects the slit outer blade plate 142B bent in the shape of a horizontal "U" in the outer blade support 1436 of the outer blades 142 with slit ports and keeps the slit inner blade 145 at a fixed position of the outer blades 142 with slit ports. The inner blade support 145B connecting the metallic blade 145A and the blade pushing spring 1441, with a thickness almost the same as the slit outer blade plate 142B inner width, is maintained in a position that cannot become slant by the inner part of the outer blades 142 with slit ports.

The characteristics of the outer blades with slit ports of this structure are to touch the skin with outer blades, and even with the outer blades pulled in or out, to cut surely the beard with the outer blades and inner blades, and furthermore, vibrating efficiently the inner blades, to shave the beard with a good efficiency. This is because they are pulled in or out in one piece without any variation of the contact pressure of the inner blades and the outer blades. These outer blades with slit ports connecting the outer blade and the inner blade by the blade pushing spring, are designed to pull in or out in one piece the outer blades and the inner blades by the extremity springs, in the electric shaver body, in the condition where the inner blades press flexibly against the inner face of the outer blades through this blade pushing spring.

Furthermore, connecting the inner blades and the outer blades, the electric shaver mounting the outer blades in the shaver body, do not need to mount separately the outer blades and the inner blades at a fixed position, and because the outer blades connected to the inner blades are assembled and connected in the shaver body, has the characteristics to allow a very efficient, easy and simple assembling in a removable fashion of the outer blades and the inner blades. Further, the characteristic that allows the mounting of the inner blades and the outer blades at a precise fixed position has been realized because the inner blades and the outer blades are not mounted separately, but are mounted directly. Then, mounting the outer blades with the slit outer blade plates by the outer blade supports that are connected with these slit outer blades plates, mounting the inner blades with the metallic blades by the inner blade supports that these metallic plates connect, mounting the blade pushing springs and the metallic blades in the inner blade supports, pressing the inner blade supports by these blade pushing springs, the outer blades with slit ports pressing the metallic blades of the inner blades against the inner faces of the slit outer blades plates, have the characteristic to allow them to press flexibly the inner blades by a simple structure against the inner faces of the outer blades.

Furthermore, connecting the blade pushing springs that are laminated springs in the inner blade supports laminated in the metallic blades, or making the thickness of the blade springs, the metallic blades and the inner blades supports connected in a laminated condition, almost the same as the inner width of the slit outer blade plates, the outer blades with slit ports maintaining the laminated springs, the metallic blades and the inner blade supports by the slit out blade plates, allows the realization of the characteristic to mount and connect precisely at a precise position the metallic blades of the inner blades and the blade pushing springs by a structure made more simple.

Furthermore, the electric shaver shown in FIG. 15 is provided with the trimmer blade 1442.

Figure 31:
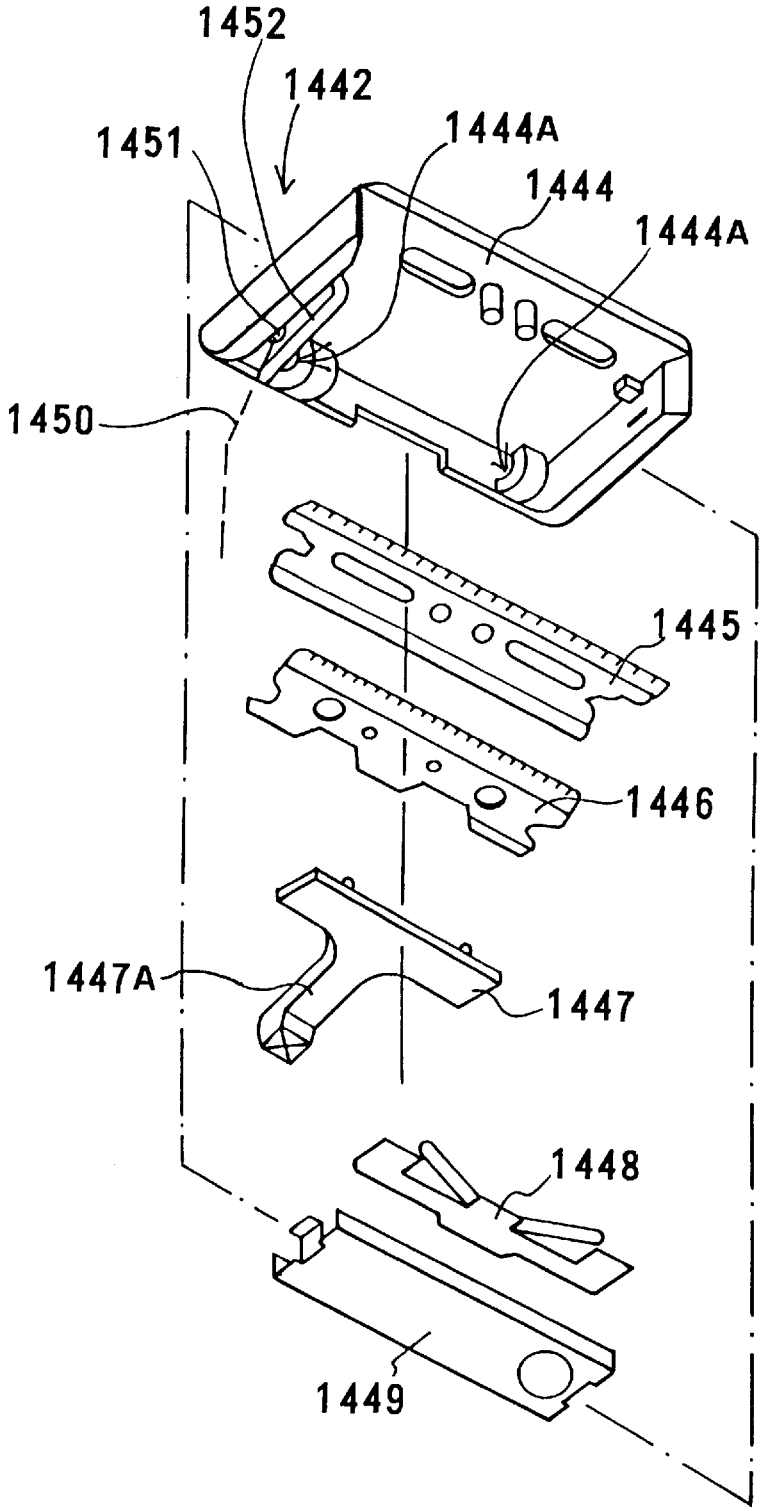
FIG. 31 is an exploded oblique view showing a trimmer blade of the electric shaver shown in FIG. 15.

FIG. 31 shows an exploded oblique view of the trimmer blade 1442.

The trimmer blade 1442 shown in this figure is connected to the shaver body 1424 via a protruding stage 1443 of FIG. 15. This trimmer blade 1442 is provided with a trimmer base stage 1444 connected to the shaver body in a free pivoting fashion, a fixed blade 1445 fixed protruding from the extremity of this trimmer base stage 1444, a mobile blade 1446 moving in a reciprocating motion and rubbing this fixed blade 1445 in a close contact condition, a driving stage 1447 for the reciprocating motion of the mobile blade 1446, a trimmer spring 1448 pushing flexibly the mobile blade 1446 via the driving stage 1447 against the fixed blade 1445, and a spring cover 1449 connected to the trimmer base stage 1444 and pushing the trimmer spring 1448.

The trimmer base stage 1444 is mounted at the upper extremity of the protruding stage 1443 in a manner allowing rotation. The trimmer base stage 1444 is provided with an axis hole 1444A used to introduce the rotating central axis (not shown in the figure) placed in the protruding stage 1443. Furthermore, the trimmer base stage 1444 is built in one piece with a flange mounting the fixed blade at a fixed position, and with a rib 1452 having the connecting port 1451 that connects the folding lever 1450 folding the trimmer blade 1442.

The fixed blade 1445 and the mobile blade 1446 that cut the beard in a relative motion, are made of a sheet metal with a comb-like edge. The fixed blade 1445 is opened with the through hole connecting at a fixed position of the trimmer base stage 1444 and the mobile blade 1446, with the through hole connecting the driving stage 1447 at a fixed position.

The driving stage 1447 is a global T-shaped plastic part that protrudes with a vibrator lever 1447A connected with a central vibrator arm 1453. The driving stage 1447 is designed with a flange that connects the mobile blade 1446 at a fixed position.

The trimmer spring 1448 is a laminated spring pushing the mobile blade 1446 against the fixed blade 1445 by the oblique wing-shaped arms. The spring cover 1449 made of embossed sheet metal connects the trimmer base stage 1444 with the flanges protruding at both extremities.

The trimmer blade 1442 rotates through a folding lever 1450 built-in to allow the up-down motion in the shaver body 1424. As shown in FIG. 15, the folding lever 1450 extends upwards along and narrow arm that is connected with the connecting port 1451 of the trimmer base stage 1444, passing through the body case 1425 of the shaver body 1424. When the folding lever 1450 is raised, the trimmer blade 1442 is raised up perpendicular to the shaver body 1424. When the folding lever 1450 is lowered, the trimmer blade 1442 is folded.

Figure 32:
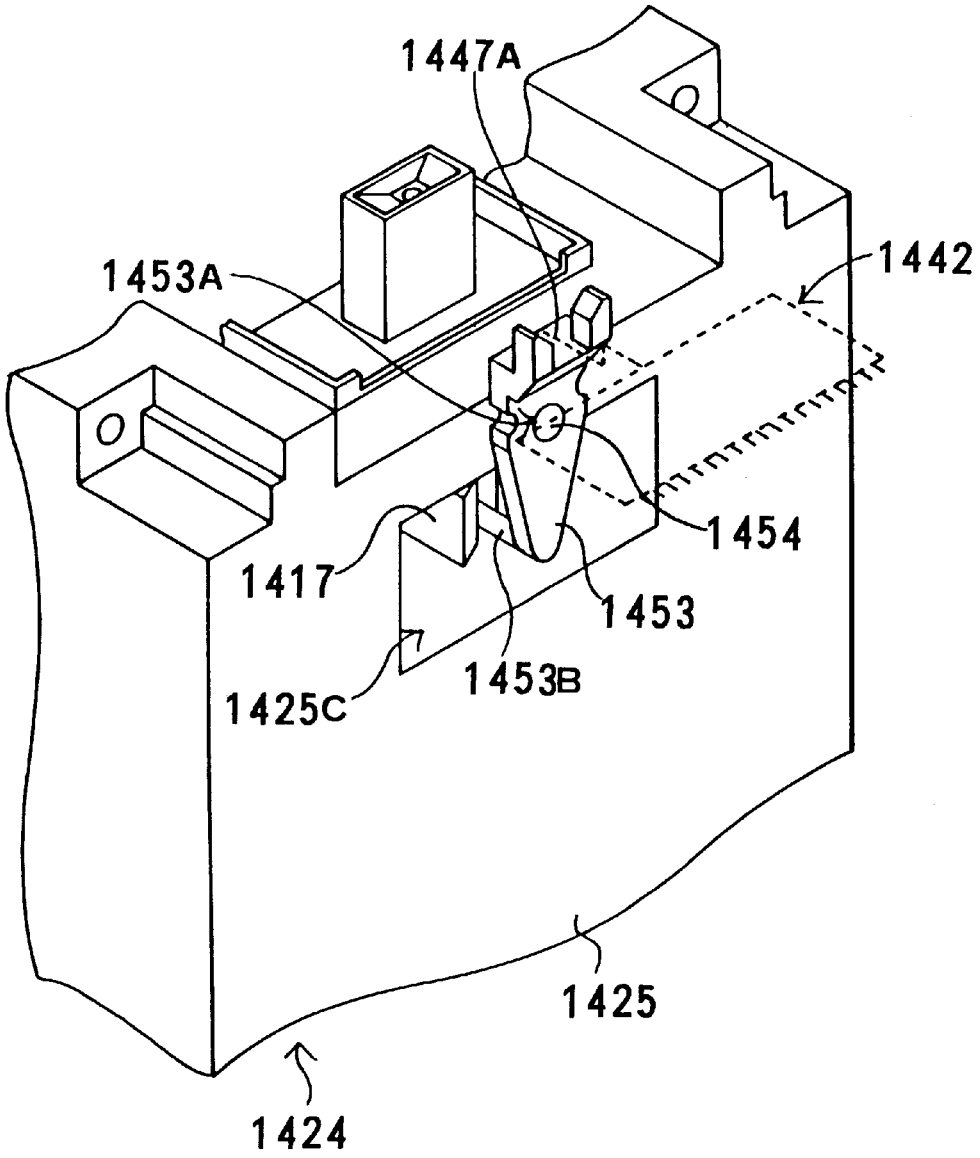
FIG. 32 is oblique view showing the connecting part of a central vibrator arm in the shaver body.

The vibrator lever 1447A of the driving stage 1447 is connected through the central vibrator arm 1453, with the vibrator stage 1417 built-in in the shaver body 1424. The part connecting the central vibrator arm 1453 in the shaver body 1424 is shown in FIG. 32. The central vibrator arm 1453 shown in this figure connects through the revolving axis 1454, the external side surface of the shaver body 1424 in a free revolving fashion. The revolving axis 1454 is built in one piece with the plastic body case 1425. The revolving axis 1454 is positioned vertically on the surface of the body case 1425. The central vibrator arm 1453 connects the body case 1425 in a manner allowing rotation, by introducing the through hole 1453A placed at the middle in this revolving axis 1454.

In the central vibrator arm 1453 connecting the trimmer blade 1442 in the vibrator stage 1417, the lower extremity is connected with the vibrator stage 1417 and the upper extremity with the vibrator lever 1447A. The upper extremity of the central vibrator arm 1453 is formed with a ditch opened upwards to allow the connection of the vibrator lever 1447A of the trimmer blade 1442. The lower extremity of the central vibrator arm 1453 connects the protuberance 1453B to allow introduction in the connecting ditch designed in the vibrator stage 1417. The protuberance 1453B protruded inwards from the opening 1425C of the body case 1425 and is connected to the vibrator stage 1417.

The central vibrator arm 1453 moves in a reciprocating motion via the vibrator stage 1417 centered on the revolving axis 1454 and the reciprocating motion of upper extremity of the central vibrator arm 1453 is transmitted by the vibrator lever 1447A, moving the trimmer blade 1442 in a reciprocating motion.

The protruding stage 1443 connecting the trimmer blade 1442 in the shaver body 1424 is fixed by screwing in the external side of the upper part of the shaver body 1424. The revolving central axis that is the revolving central axis of the trimmer blade 1442 is positioned in the protruding stage 1443 more upward than the upper extremity of the shaver body 1424. Introduced in the axis hole 1444A of the trimmer base stage 1444, the revolving central axis is connected to allow the trimmer base stage 1444 to turn. The protruding stage 1443 has an extension part 1443A extended upward because the revolving central axis protrudes beyond the shaver body 1424. The revolving central axis is designed in those surface by the upper extremity of the extension part 1443A. FIG. 15 does not show the revolving central axis because it shows the back side of the protruding stage 1443. The revolving central axis is placed at the back side hidden by the upper edge of the extension part 1443A of the protruding stage 1443 shown in this figure.

The revolving axis connecting the central vibrator arm 1453 with the shaver body 1424, is placed between the protruding stage 1443 and the shaver body 1424. The central vibrator arm 1453 located here is interposed between the protruding stage 1443 and the shaver body 1424 is connected so that it is not slant. The protruding stage 1443 is provided with the latch groove 1443B on the opposite face of the shaver body 1424 to position the central vibrator arm 1453.

The characteristics of the electric shaver of this structure are not only to mount the trimmer blade separated and in an easy to use location but also to allow the efficient reciprocating motion of the trimmer blade. This is because the electric shaver of the present invention connects the vibrator lever of the trimmer blade with the vibrator stage through the central vibrator arm and connects also the middle of the central vibrator arm with the shaver body through the revolving axis. Because the central vibrator arm that transmits the reciprocating motion of the vibrator stage to the trimmer blade, is connected by its middle with the shaver body, it is possible to limit the real length of the arm that vibrates, at half the interval between the vibrator lever and the vibrator stage, and it is also possible to reduce the useless vibrations of the central vibrator arm because the central vibrator arm is not connected in a free condition but this middle can turn in the shaver body. Therefore, transmitting efficiently the reciprocating motion of the vibrator stage to the trimmer blades, the central vibrator arm realizes the feature of reducing the noise, etc.

Furthermore, the characteristic of the electric shaver mounted with the trimmer blade in the shaver body through the protruding stage and with the revolving central axis of the trimmer blade positioned in the protruding stage beyond the upper extremity of the shaver body, is to make the use of the trimmer blade placed upwards, extremely convenient.

Then, the characteristic of an electric shaver that mounts the revolving axis that connects the central vibrator arm between the protruding stage and the shaver body, and that keeps the central vibrating arm revolving between the protruding stage and the shaver body, is to allow the connection of the central vibrator arm to the shaver body without being slant. Especially, because the protruding stage is used as a part avoiding the slant mounting of the base stage that connects the trimmer lever and the central vibrator arm, the feature of this structure is to set in an ideal position and by a simple structure, the protruding stage, the trimmer blade and the central vibrator arm.

As this invention may be embodied in several forms without departing from the spirit of essential characteristics thereof, the present embodiment is therefore defined by the appended claims rather than by the description preceding them and all changes that fall within and metes and bounds of the claims, or equivalents of such metes and bounds thereof are therefore intended to be embraced by the claims.

What is claimed is:

1. An electric shaver apparatus comprising:

a pair of elongated arched outer blades, each of said arched outer blades comprising a mesh cutter having plural beard cutting ports, an inner face and an outer face and being formed in an arch shape opening in a first direction, said arched outer blades having internal sides facing one another and external sides facing away from one another;

a pair of arched inner blades comprising blade edges profiled in a shape complementary to said inner faces of said arched outer blades, respectively, said arched inner blades being movably mounted relative to said arched outer blades, respectively, such that, when said arched inner blades move relative to said arched outer blades, respectively, said blade edges rub against said inner faces of said arched outer blades;

a pair of elongated slit port outer blades arranged parallel to and on at least one of the external sides of said arched outer blades;

wherein each of said slit port outer blades has an inner face and an outer face and has a profile opening in said first direction, flattened at a surface facing a second direction opposite said first direction and having an external side facing away from said arched outer blades;

wherein each of said slit port outer blades has a plurality of elongated parallel slit ports extending, in a transverse direction of said slit port outer blade, across at least part of the flattened surface, around a corner between said flattened surface and said external side of said slit port outer blade, and across at least part of said external side of said slit port outer blade; and wherein slit inner blades, comprising blade edges profiled in a shape complementary to said inner faces of said slit port outer blades, are mounted for movement relative to said slit port outer blades, respectively, such that, when said slit inner blades move relative to said slit port outer blades, respectively, said blade edges of said slit inner blades rub against said inner faces of said slit port outer blades.

2. An electric shaver apparatus as recited in claim 1, wherein said slit port outer blades have a thickness greater than a thickness of said arched outer blades; and each of said slit ports has an opening area greater than an opening area of each of said beard cutting ports.

3. An electric shaver apparatus as recited in claim 1, wherein said arched outer blades protrude further in said second direction than said slit port outer blades.

4. An electric shaver apparatus as recited in claim 1, wherein said slit port outer blades are respectively mounted on the opposing external sides of said arched outer blades, such that said arched outer blades are disposed between said slit port outer blades.

5. An electric shaver apparatus as recited in claim 4, wherein said slit inner blades are mounted for reciprocating movement relative to one another, said arched inner blades are mounted for reciprocating movement relative to one another, one of said slit inner blades is mounted for movement together with one of said arched inner blades, and the other of said slit inner blades is mounted for movement with the other of said arched inner blades.

6. An electric shaver apparatus as recited in claim 1, further comprising at least one elongated comb mounted adjacent and parallel to at least one of said slit port outer blades.

7. An electric shaver apparatus as recited in claim 6, further comprising a support member;

wherein said comb is mounted to said support member;

wherein said arched outer blades and said slit port outer blades are movably mounted to said support member for movement, respectively, between normal extended positions and pushed-down positions; and wherein, in said normal extended positions, said arched outer blades and said slit port outer blades protrude in said second direction further than said at least one comb.

8. An electric shaver apparatus as recited in claim 6, further comprising a support member;

wherein said comb is mounted to said support member;

wherein said arched outer blades and said slit port outer blades are movably mounted to said support member for movement respectively, between normal extended positions and pushed-down positions; and wherein, in said pushed-down positions, said arched outer blades, said slit port outer blades and said at least one comb protrude equally in said second direction.

9. An electric shaver apparatus as recited in claim 6, wherein said slit port outer blades have a thickness greater than a thickness of said arched outer blades; and each of said slit ports has an opening area greater than an opening area of each of said beard cutting ports.

10. An electric shaver apparatus as recited in claim 6, wherein said at least one comb includes plural teeth spaced apart at a given interval;

said slit ports of said slit port outer blades are of a given dimension in a longitudinal direction of said slit port outer blades; and said given interval at which said teeth of said at least one comb are spaced apart are greater than said given dimension of said slit ports of said slit port outer blades.

11. An electric shaver apparatus as recited in claim 6, wherein said slit port outer blades are respectively mounted on the opposing external sides of said arched outer blades, such that said arched outer blades are disposed between said slit port outer blades.

12. An electric shaver apparatus as recited in claim 11, wherein said at least one comb comprises a pair of combs respectively mounted on the external sides of said slit port outer blades.

13. An electric shaver apparatus as recited in claim 6, wherein said at least one comb has teeth which protrude outwardly in a curved manner away from said slit port outer blades.

14. An electric shaver apparatus as recited in claim 1, wherein blade pushing springs are respectively mounted between said slit inner blades and said slit port outer blades.

15. An electric shaver apparatus as recited in claim 14, wherein said slit inner blades are movably mounted in said slit port outer blades; and said blade pushing springs respectively serve to flexibly press said slit inner blades in a direction toward and against the inner faces of said slit port outer blades.

16. An electric shaver apparatus as recited in claim 14, further comprising a shaver body; and extremity springs flexibly and movably mounting said slit port outer blades in said shaver body.

17. An electric shaver apparatus as recited in claim 14, wherein each of said slit port outer blades comprises an outer blade support and a slit outer blade plate mounted to said outer blade support.

18. An electric shaver apparatus as recited in claim 14, wherein each of said slit inner blades comprises an inner blade support and a metallic blade mounted to said inner blade support.

19. An electric shaver apparatus as recited in claim 18, wherein said blade pushing springs are further mounted to said inner blade supports, respectively, such that said blade pushing springs respectively push said metallic blades against the inner faces of said slit port outer blades.

20. An electric shaver apparatus as recited in claim 19, wherein said blade pushing springs, said metallic blades and said inner blade supports are mounted together in a laminated manner, respectively, to form laminated members.

21. An electric shaver apparatus as recited in claim 20, wherein said blade pushing springs respectively comprise flexible pieces which resiliently push upper faces of said inner blade supports, respectively;

a thickness of each of said laminated members is approximately equal to an inner width of each of said slit outer blade plates; and said laminated members are respectively retained in said slit outer blade plate.

22. An electric shaver apparatus as recited in claim 1, further comprising a shaver body; and wherein said arched outer blades and said slit port outer blades are mounted in said shaver body.

23. An electric shaver apparatus as recited in claim 22, further comprising an outer blade case;

a central stage mounted to said outer blade case; and wherein said arched outer blades and said slit port outer blades are connected to said central stage.

24. An electric shaver apparatus as recited in claim 23, wherein said outer blade case is formed as a frame; and said central stage is mounted in said outer blade case and comprises a pair of flexible plates and at least one connecting rod connecting said flexible plates together in a spaced apart manner such that said central stage fits tightly in said outer blade case with the said flexible plates flexibly pressing outwardly against an inside of said outer blade case.

25. An electric shaver apparatus as recited in claim 23, wherein said arched outer blades and said slit port outer blades are movably mounted in said central stage.

26. An electric shaver apparatus as recited in claim 25, further comprising extremity springs resiliently pushing said arched outer blades and said slit port outer blades outwardly from said central stage.

27. An electric shaver apparatus as recited in claim 24, wherein said flexible plates extend substantially in said first and second directions so as to have upper ends and lower ends spaced from said upper ends in said second direction;

said at least one connecting rod of said central stage connects between said upper ends of said flexible plates; and said at least one connecting rod is mounted between one of said arched outer blades and one of said slit port outer blades disposed adjacent said one of said arched outer blades.

28. An electric shaver apparatus as recited in claim 1, further comprising a shaver body to which said arched outer blades and said slit port outer blades are mounted; and a foldable trimmer blade mounted to a side face of said shaver body.

29. An electric shaver apparatus as recited in claim 28, further comprising a vibrator stage mounted to said shaver body; and a vibrator lever connecting said trimmer blade to said vibrator stage.

30. An electric shaver apparatus as recited in claim 29, further comprising a central vibrator arm, said vibrator lever being connected to said vibrator stage via said central vibrator arm.

31. An electric shaver apparatus as recited in claim 30, wherein said central vibrator arm is pivotally mounted to said shaver body for pivoting about a revolving axis.

32. An electric shaver apparatus as recited in claim 30, wherein said central vibrator arm is vertically and pivotally mounted, at a middle portion thereof, to a surface of said shaver body for pivoting about a revolving pin defining a revolving axis.

33. An electric shaver apparatus as recited in claim 32, wherein said central vibrator arm has an upper end and a lower end;

said upper end of said central vibrator arm is connected to said vibrator lever, and said lower end of said central vibrator arm is connected to said vibrator stage; and said vibrator stage is operable to reciprocate said lower end of said central vibrator arm, such that said central vibrator arm pivots about said revolving axis, said upper end of said central vibrator arm reciprocates to reciprocate said vibrator lever, and said vibrator lever drives said trimmer blade in a reciprocating motion.

34. An electric shaver apparatus as recited in claim 28, further comprising a protruding stage mounted to said shaver body; and wherein said trimmer blade is mounted to said protruding stage.

35. An electric shaver apparatus as recited in claim 34, wherein said trimmer blade is foldably mounted to said protruding stage for folding about a trimmer blade axis positioned above an upper end of said shaver body.

36. An electric shaver apparatus as recited in claim 31, further comprising a protruding stage mounted to said shaver body;

wherein said trimmer blade is mounted to said protruding stage;

wherein said trimmer blade is foldably mounted to said protruding stage for folding about a trimmer blade axis positioned above an upper end of said shaver body;

wherein said revolving axis is disposed between said protruding stage and said shaver body; and wherein said central vibrator arm is rotatably disposed between said protruding stage and said shaver body.

37. An electric shaver apparatus as recited in claim 1, further comprising a shaver body including a body case and a decoration panel mounted on a surface of said body case;

wherein said body case includes a latching detent;

wherein said decoration panel has at least a conductive external surface and includes a latching piece; and wherein said latching piece hooks to said latching detent to secure said decoration panel to said body case.

38. An electric shaver apparatus as recited in claim 37, wherein said latching detent of said body case comprises a latching groove opening in a surface of said body case.

39. An electric shaver apparatus as recited in claim 38, further comprising electronic parts mounted in said body case;

an insulating base plate, formed as one piece with said body case, closing said latching groove and insulating said latching piece and said electronic parts.

40. An electric shaver apparatus as recited in claim 39, wherein said latching groove extends vertically in said first and second directions, and is provided with a latching rib at one of an upper end and a lower end thereof; and said latching piece is formed as a hook for latching to said latching rib.

41. An electric shaver apparatus as recited in claim 39, further comprising a stopper flange provided on an inner surface of said decoration panel for engaging an edge of said latching groove to prevent movement of said decoration panel relative to said body case in a releasing direction.

42. An electric shaver apparatus as recited in claim 1, wherein each of said slit port outer blades comprises an outer blade support and a slit outer blade plate;

said slit outer blade plate is formed of a metal sheet in a generally flattened arch shape and includes connecting parts, at lower portions of opposite sides of said arch shape, for connecting said slit outer blade plate to said outer blade support.

43. An electric shaver apparatus as recited in claim 42, wherein said outer blade support has an interior and an exterior, external connecting faces on the exterior and internal connecting faces in the interior; and said connecting parts of said slit outer blade plate comprise external connecting parts respectively locked to said external connecting faces of said outer blade support by locking structures, and internal connecting parts respectively locked to said internal connecting faces by locking structures.

44. An electric shaver apparatus as recited in claim 43, wherein said locking structures comprise through holes formed in said connecting parts and latching flanges provided on said outer blade support and protruding into said through holes, respectively.

45. An electric shaver apparatus as recited in claim 43, wherein a first one of said external connecting parts protrudes downwardly from a lower edge of said slit outer blade plate on one of the opposite sides of said arch shape, and a second one of said external connecting parts protrudes downwardly from a lower edge of said slit outer blade plate on the other of the opposite sides of said arch shape;

a first one of said internal connecting parts protrudes downwardly from a lower edge of said slit outer blade plate on said one of the opposite sides of said arch shape, and a second one of said internal connecting parts protrudes downwardly from a lower edge of said slit outer blade plate on said other of the opposite sides of said arch shape;

said first one of said external connecting parts and said first one of said internal connecting parts are coplanar;

said second one of said external connecting parts and said second one of said internal connecting parts are coplanar.

46. An electric shaver apparatus as recited in claim 45, wherein said external connecting parts comprise two external connecting parts, located respectively at opposing ends of said slit outer blade plate, on each of said opposite sides of said arch shape;

said internal connecting parts comprise one internal connecting part centrally between said two external connecting parts on each of said opposite sides of said arch shape.

* * * * *